US006178292B1

(12) United States Patent
Fukuoka et al.

(10) Patent No.: US 6,178,292 B1
(45) Date of Patent: Jan. 23, 2001

(54) CORE UNIT OF HEAT EXCHANGER HAVING ELECTRIC HEATER

(75) Inventors: Mikio Fukuoka, Bisai; Mitsugu Nakamura, Chiryu; Isao Kuroyanagi, Anjo; Toshio Ohara, Kariya; Sadayuki Kamiya, Kariya; Shinji Naruse, Kariya; Yoshifumi Aki, Kariya; Michiyasu Yamamoto, Chiryu; Hiroyuki Sato, Kariya, all of (JP)

(73) Assignee: Denso Corporation, Kariya (JP)

( * ) Notice: Under 35 U.S.C. 154(b), the term of this patent shall be extended for 0 days.

(21) Appl. No.: 09/459,867

(22) Filed: Dec. 13, 1999

Related U.S. Application Data

(63) Continuation-in-part of application No. 09/014,963, filed on Jan. 28, 1998.

(30) Foreign Application Priority Data

| | | |
|---|---|---|
| Feb. 6, 1997 | (JP) | 9-24154 |
| Apr. 10, 1997 | (JP) | 9-92417 |
| Aug. 8, 1997 | (JP) | 9-215042 |
| Dec. 16, 1998 | (JP) | 10-358153 |

(51) Int. Cl.[7] ..... F24H 1/10; H05B 3/78; F28F 9/02

(52) U.S. Cl. ..... 392/485; 392/377; 165/175; 165/181

(58) Field of Search ..... 165/153, 152, 165/177, 175, 181; 219/630, 208; 392/377, 465, 485

(56) References Cited

U.S. PATENT DOCUMENTS

| | | |
|---|---|---|
| Re. 35,742 | 3/1998 | Hoshino et al. . |
| 4,899,032 | 2/1990 | Schwarzl et al. . |
| 5,057,672 | 10/1991 | Bohlender et al. . |
| 5,172,762 | 12/1992 | Shinmura et al. . |
| 5,192,853 | 3/1993 | Yeh . |
| 5,239,163 | 8/1993 | Brouwers . |
| 5,256,857 | 10/1993 | Curhan et al. . |
| 5,311,935 | 5/1994 | Yamamoto et al. . |
| 5,457,885 | 10/1995 | Ohashi et al. . |
| 5,665,261 | 9/1997 | Damsohn et al. . |
| 5,678,628 | 10/1997 | Aki et al. . |

FOREIGN PATENT DOCUMENTS

| | | |
|---|---|---|
| 44 33 814 A1 | 3/1996 | (DE) . |
| 63-203411 | 8/1988 | (JP) . |
| 5-69732 | 3/1993 | (JP) . |
| 6-75819 | 10/1994 | (JP) . |
| 10-217754 | 8/1998 | (JP) . |
| 10-288493 | 10/1998 | (JP) . |

*Primary Examiner*—Teresa Walberg
*Assistant Examiner*—Thor Campbell
(74) *Attorney, Agent, or Firm*—Harness, Dickey & Pierce, PLC

(57) ABSTRACT

A core unit of a heat exchanger is composed of a plurality of parallel flat tubes, a plurality of corrugated fins, a support member disposed between two of the corrugated fins and an electric heater disposed inside the support member. The support member has a pair of parallel plates bonded to the corrugated fins at the summits of corrugation of the corrugated fins. The electric heater is composed of a heating element and an insulation member inserted between the heating element and the parallel plates.

37 Claims, 20 Drawing Sheets

CORE UNIT OF HEAT EXCHANGER HAVING ELECTRIC HEATER

CROSS REFERENCE TO RELATED APPLICATION

The present application is a CIP application of Ser. No. 09/014,963 filed Jan. 28,1998 and is also based on claims priority from Japanese Patent Application Hei 10-358153 filed on Dec. 16, 1998, the contents of which are incorporated herein by reference.

BACKGROUND OF THE INVENTION

1. Field of the Invention

The present invention is related to a heat exchanger of a heater in which an electric heater is disposed integrally therewith to heat air in addition to hot water heated by a vehicle engine.

2. Description of the Related Art

Conventional heat exchangers having an integrated electric heater therein are disclosed in JP-A-5-69732 and JP-A-63-203411. A heat exchanger of a heater in which hot water or engine coolant is used to heat air is provided with an integrated electric heater. When the coolant temperature is low, for example when the engine is just started, the electric heater is turned on to generate heat, thereby heating air. This structure reduces pressure loss in the heating air blow system of the heater as compared with a structure having a separate PTC heater. Because the PTC heater has a positive temperature characteristic sharply changing the resistance thereof at a set temperature, it is not necessary to provide a temperature control circuit so that the driving circuit thereof can be made simple.

The electric heater is composed of a PTC element and electrodes and is soldered to a heat exchanger core. Therefore, the PTC element is exposed to high-temperature air for soldering (e.g. 600° C. for soldering aluminum members) and, accordingly, the electric characteristic of the heater element may be damaged substantially.

In a common air conditioning system for a vehicle, a heat exchanger of a heater is disposed at a downstream side of a heat exchanger for cooling air to control reheating by the heat exchanger of the heater, thereby controlling temperature of the air blown into the passenger compartment of the vehicle. Therefore, condensed water formed on the heat exchanger for cooling air or snow coming from the air inlet may adhere the front surface of the heat exchanger of the heater. Because the electric heater is exposed to the outside from the heat exchanger core, the water or snow may cause short circuiting or electric leakage.

In the above conventional device disclosed in the publication, it is only disclosed that the set temperature of the PTC heater is 80° C. There is no explanation about how to decide the set temperature. Our experiments have revealed that the heat generated by the PTC heater may not be utilized for the heating air to be heated if the set temperature of the PTC heater is not suitable.

In a core unit of a heat exchanger, a plurality of flat tubes for conducting water or engine coolant are parallelly disposed, and each of a plurality of corrugated fins is disposed between two of the flat tubes. If a PTC heater is installed in place of one of the flat tubes, the heat of the PTC heater is conducted via the corrugated fins and the adjacent flat tubes to the water. If the PTC heater is powered when the water temperature is low, temperature of portions of the corrugated fins adjacent to the PTC heater becomes higher than the temperature of portions of the corrugated fins adjacent to the flat tubes. If the set temperature of the PTC is too high, the heat generated by the PTC heater is transmitted to the water. That is, the PTC heater can not heat the heating air to be used for the heater effectively. On the other hand, if the set temperature is too low, the PTC heater can not generate power sufficient to heat the heating air.

SUMMARY OF THE INVENTION

The present invention has been made, in view of the above problems, to provide a core unit of a heat exchanger in which an electric heater can be installed without damage.

According to a feature of the present invention, a core unit of a heat exchanger is composed of a plurality of parallel flat tubes, a plurality of corrugated fins, a support member disposed between two of the corrugated fins, and an electric heater disposed inside the support member. The support member has a pair of parallel plates bonded to the corrugated fins at the summit of corrugation, and the electric heater comprises a heating element and an insulation member inserted between the heating element and the parallel plates.

Accordingly, the support plates can be soldered to the corrugated fins before the electric heater is inserted between the two support plates. Therefore, the electric characteristic of the electric heater is not damaged during the soldering step of the core unit. Although the corrugated fins have complicated shape, the electric heater can be inserted easily without damage to the corrugated fins. Further, because the electric heater is inserted between and insulated from the two support plates, electric current can be supplied to the electric heater without passing metal portions (tubes, etc.) of the core unit, so that electric corrosion of the metal portions of the core unit can be prevented. Moreover, even if the height of the corrugations of the corrugated fins are formed uneven, solder melts and moves due to capillarity and fills gaps between the summits of the corrugation of the corrugated fins and the support plates. Thus, the summits of corrugation of the corrugated fins can be soldered to the support plates with confidence, and heat generated by the electric heater can be conducted from the support plates to the corrugated fins effectively.

It is another object of the present invention to prevent short circuiting and electric leakage caused by condensed water or the like.

According to another feature of the present invention, a core unit of a heat exchanger core having an air inlet side and an air outlet side includes a plurality of parallelly disposed flat tubes which conduct the heat carrier, a plurality of corrugated fins, a U-shaped support member having a pair of plates parallelly extending along the flat tubes, an opening end portion and a U-shaped closing end portion, and an electric heater disposed between the support plates and insulated from the support member. The support member is disposed between the summits of corrugation of adjacent two of the corrugated fins, the U-shaped closing end portion is disposed at the air inlet side, and each of the plates is bonded to one of the corrugated fins at the summits of corrugation. The opening end portion preferably projects from an end of the electric heater. The opening end portion may spread in a skirt-shape. The support member may have the same thickness as the core unit in the air flow direction, and the electric heater may have smaller thickness in the direction of core thickness than the support member.

Because the U-shaped closing portion of the support member is disposed at the air inlet side of the heat exchanger core, the closing portion prevents water from entering the inside of the support member even if water adheres to an upstream portion of the core unit. Therefore, condensed water can not adhere to the electric heater, and the short circuiting or electric leak of the electric heater due to water is prevented. Because the opening portion of the support member projects from an end of the electric heater, water can be prevented from adhering to the electric heater even if water moves along the surface of the support member to the opening portion.

It is another object of the present invention is to provide an improved core unit of a heat exchanger for heating air by hot water or engine coolant having a PTC heater which can heat the heating air at a maximum efficiency.

According to another feature of the present invention, a core unit of a heat exchanger core includes a plurality of parallelly disposed flat tubes which conduct the heat carrier, a plurality of corrugated fins having summits of corrugation disposed between two of the flat tubes, and an electric heater disposed between two of the summits of corrugation instead of one of the flat tubes. The electric heater has a positive temperature characteristic sharply changing resistance thereof at a set temperature and heats portions of the fins adjacent to the flat tubes at a temperature equal to temperature of water in the flat tubes if the water temperature is equal to or higher than 60° C. and temperature of air to be heated is equal to or lower than 0° C.

Usually, the diesel engine operates at a high efficiency, and the water temperature thereof can not rise sufficiently even after engine has warmed up. In such a highly efficient engine, the water temperature may not rise up to 60° C. If the water temperature in the flat tubes does not rise above 60° C., the heat generated by the PTC heater is not transmitted to the water, so that the PTC heater can heat the heating air efficiently.

According to another feature of the present invention, a core unit of a heat exchanger core includes a plurality of parallelly disposed flat tubes which conduct the heat carrier, a plurality of corrugated fins each of which is disposed between two of the flat tubes, a PTC heater disposed at a portion of the core unit instead of the flat tubes. The corrugated fins have summits of corrugation disposed between two of the flat tubes which has a height between 3.9 mm and 5 mm, and the set temperature of the PTC heater is between 85° C. and 110° C. The electric heater is preferably a three-layered sandwich structure composed of an electric heater element and two flat electrodes on opposite sides of the electric heater element and is inserted between the corrugated fins and the two electrodes, and the two electrodes are press-fitted to the summits of the corrugation. The PTC heater may have a heater element whose positive temperature characteristic sharply changing resistance thereof at temperature between 120° C. and 170° C.

According to the inventor's study, the height and the set temperature of the PTC heater are set as the above, the heat of the PTC heater is not transmitted to the water under the conditions: the heating air temperature $\leqq 0°$ C.; the water temperature in the flat tubes $\geqq 60°$ C.

Further, the height of the fins between 3.9 mm and 5 mm reduces the difference in the temperature between the fins and the heating air, so that the corrugated-fin-type heat exchanger core unit can provide both sufficient heat radiation performance and effective heating of the heating air by the PTC heater.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Preferred embodiments of the present invention are described with reference to the appended drawings.

(First Embodiment)

Figure 1:
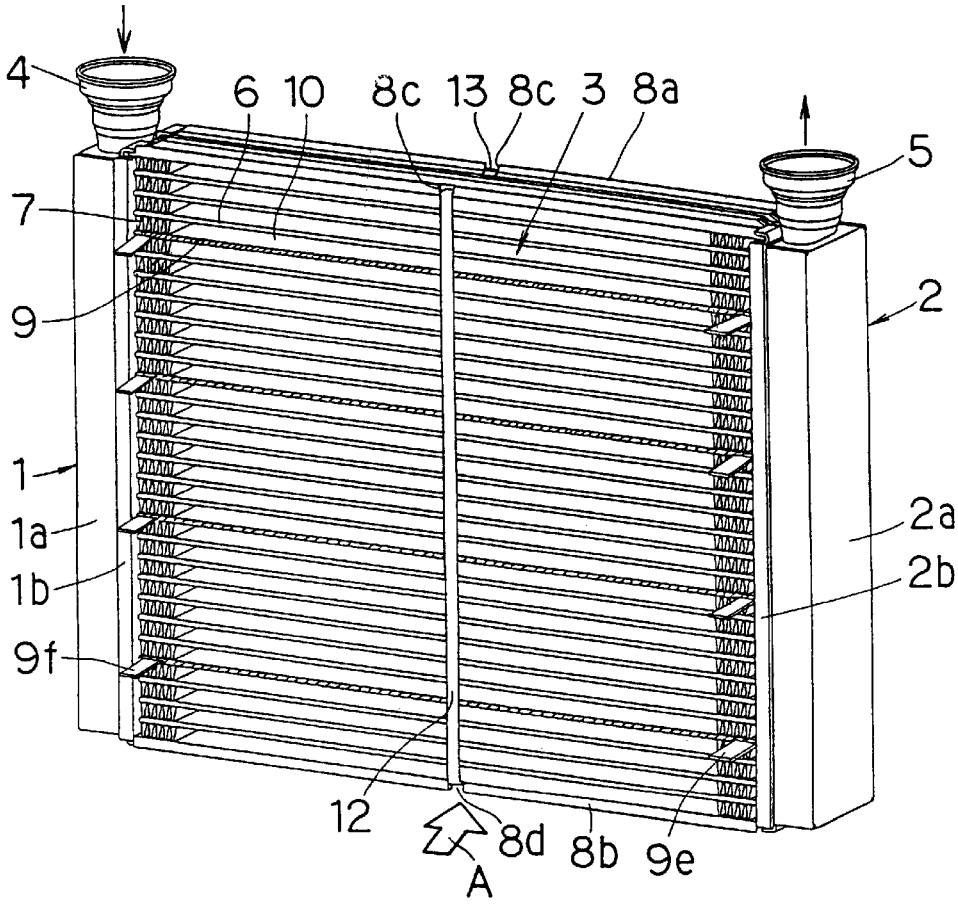
FIG. 1 is a perspective view illustrating a heat exchanger having an electric heater integrated therewith according to a first embodiment of the present invention.
Figure 2:
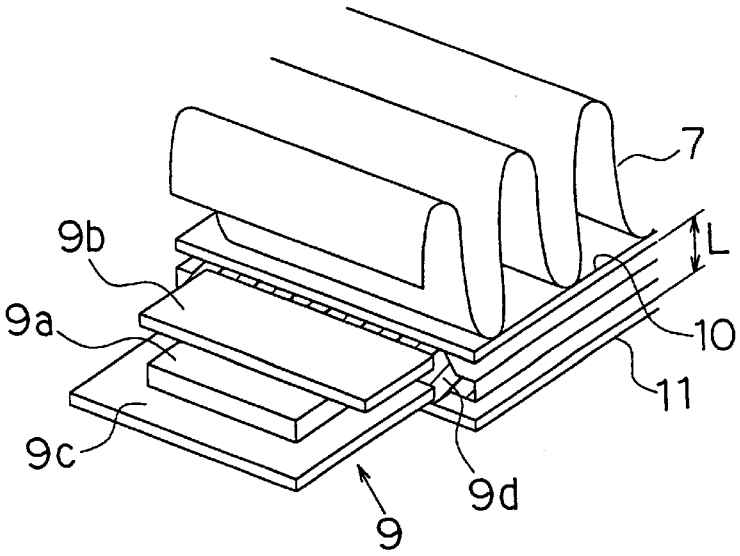
FIG. 2 is an enlarged perspective view of a portion where the electric heater is installed.
Figure 3A:
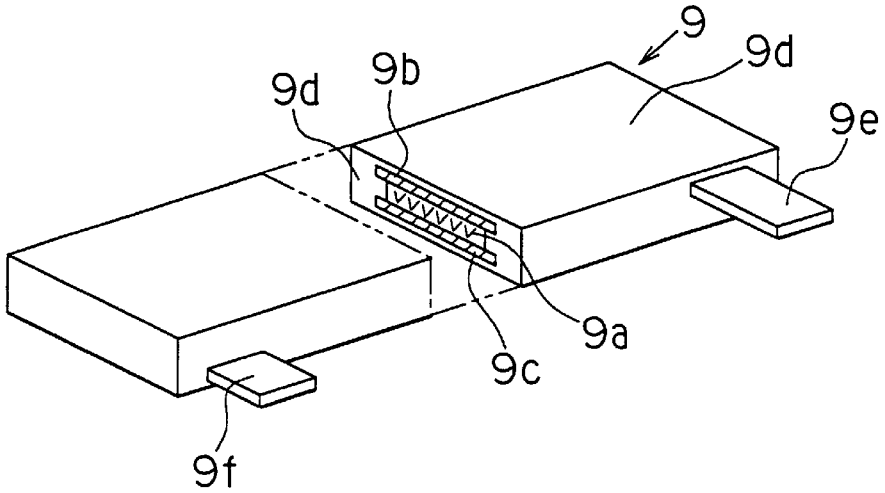
FIG. 3A is a fragmentary perspective view of the electric heater shown in FIG. 2.
Figure 3B:
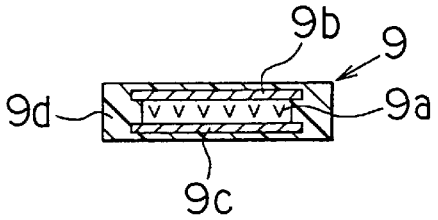
FIG. 3B is a cross-sectional side view of the electric heater.
Figure 3C:
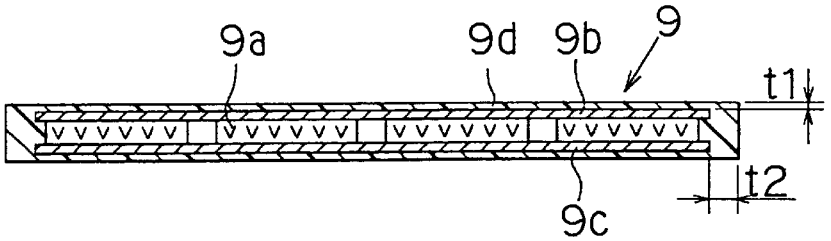
FIG. 3C is a cross-sectional elongation of the electric heater.
Figure 3D:
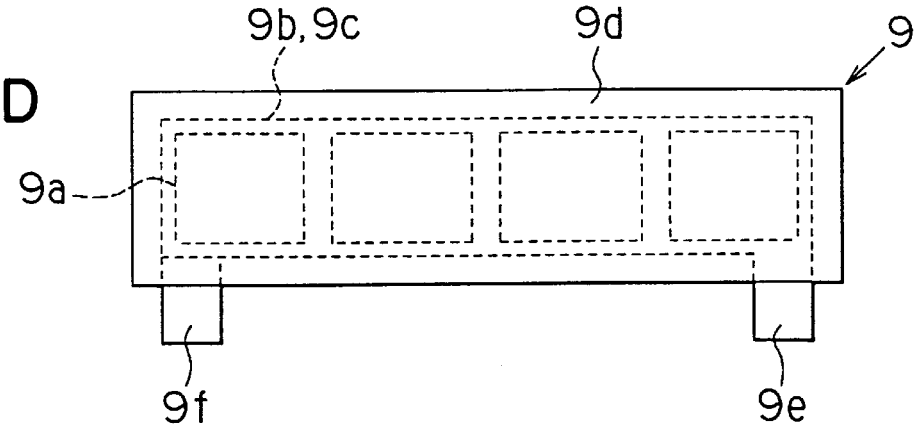
FIG. 3D is a plan view of the electric heater.
Figure 4:
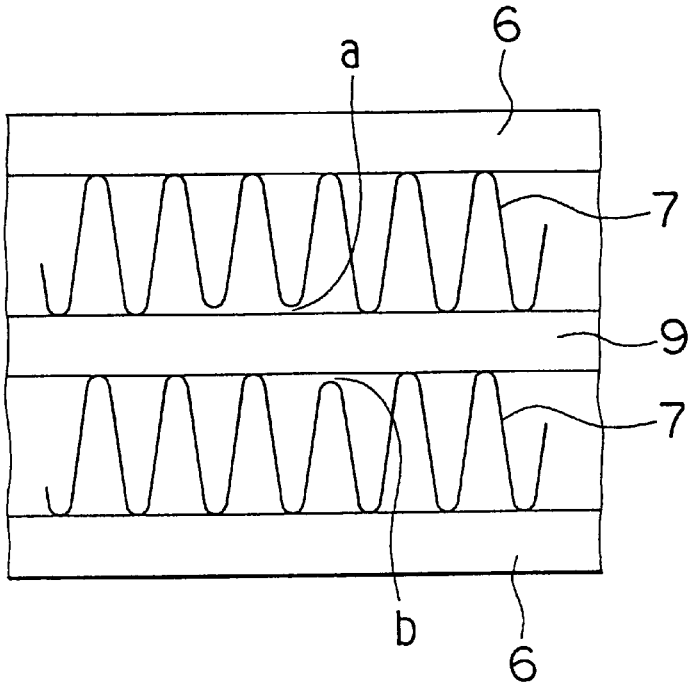
FIG. 4 is a schematic view illustrating a portion where an electric heater is disposed.

In FIGS. 1 and 2, the heat exchanger for a heater has a hot-water inlet tank 1, a hot-water outlet tank 2 and a heat exchanger core unit 3 disposed between the tanks 1 and 2. The hot-water inlet tank 1 has an inlet pipe 4 through which hot water or engine coolant flows from a vehicle engine (not shown). The hot-water outlet tank 2 has an outlet pipe 5 through which the hot water is discharged and returned to the engine. The heat exchanger is symmetrical, and therefore the hot-water inlet tank 1 and the hot-water outlet tank 2 can be exchanged.

The inlet tanks 1 is composed of a tank body 1*a*, and the outlet tank 2 is composed of a tank body 2*a*. Sheet metals 1*b* and 2*b* close the open end of the tank bodies 1*a* and 2*a* respectively. The vertical direction of the heat exchanger in FIGS. 1 and 2 is the longitudinal direction of the tanks 1 and 2. Each of the sheet metals 1*b* and 2*b* has a plurality of elliptic tube receiving holes (not shown). The elliptic tube receiving holes are formed in the vertical direction in FIGS. 1 and 2 in a single line or a plurality of lines.

The heat exchanger core unit 3 has a plurality of the flat tubes 6 stacked in the vertical direction. One of a plurality of corrugated fins 7 is disposed between each pair of the flat tubes 6 and soldered thereto. Each of the corrugated fins 7 has a plurality of louvers extending at an angle from the direction A of heating air to increase the heat exchange rate.

Opposite ends of each of the flat tubes 6 are inserted into corresponding tube receiving holes of the sheet metals 1*b* and 2*b* of the inlet and outlet tanks 1 and 2 and soldered thereto. Side plate 8*a* and 8*b* are disposed on the outermost corrugated fins 7 and are soldered to the same outermost corrugated fins 7 and to the sheet metals 1*b* and 2*b*.

A pair of support plates 10 and 11 is disposed between the summits of the corrugation of adjacent two of the corrugated fins 7 in place of one of the flat tube 6 at each one of four portions of the core unit 3 and extend in parallel with each other at a distance L. The distance L is the same as thickness of the electric heater 9. Each of four electric heaters 9 is inserted between the support plates 10 and 11 to be held therein.

Elements and components 1–8*b* of the core unit 3 as well as the support plates 10 and 11 are made of aluminum or aluminum alloy. Each of the support plates 10 and 11 is made of a thin sheet having thickness between 0.1 and 0.5 mm and width (in the direction of the hot air) having nearly the same size as the corrugated fins 7. The length (in the horizontal direction in FIG. 1) of the support plates 10 and 11 is nearly the same as the distance between the sheet metals 1*b* and 2*b*.

The electric heater 9 has a three-layered sandwich structure composed of a flat heating element 9*a* and long flat electrodes 9*b* and 9*c* disposed on the opposite surfaces of the heating element 9*a* as shown in FIGS. 3A–3D. An insulating cover 9*d* made of insulating material covers the circumferences of the electrodes 9*b* and 9*c*. The heating element 9*a* is a PTC heater element made from resistance material (such as barium titanate), which has a positive temperature characteristic increasing the resistance sharply at a set temperature T0 (e.g. around 200° C.). The thickness of the heating element 9*a* is between 1.0–2.0 mm.

The electrodes 9*b* and 9*c* are made of aluminum, copper or stainless or the like and have a thickness between 0.1–0.5 mm. The length of the electrodes 9*b* and 9*c* (horizontal size in FIG. 1) is nearly equal to the length of the support plates 10 and 11. The heating element 9*a* and the electrodes 9*b* and 9*c* are pressed to each other to provide good electric conduction.

The insulating cover 9*d* is press-fitted into the space between the support plates 10 and 11 to insulate the support plates 10 and 11 from the plates 9*b* and 9*c* and to conduct heat generated by the heating element 9*a* to the support plates 10 and 11. For this purpose, the thickness t1 of the insulating cover 9*d* disposed between the support member and one of the plates 9*b* and 9*c* is formed between 25$\mu$–100$\mu$.

The thickness t2 of the insulating cover 9*d* at the opposite sides of the heating elements is about 1–2 mm to protect the heating elements 9*a*. The insulating cover 9*d* is preferably made of high temperature resistive resin (e.g. polyimide).

Terminals 9*e* and 9*f* are formed integrally with the plus electrode 9*b* and the minus electrode 9*c* respectively to be connected to an outside circuit. The terminals 9*e* and 9*f* project from the rear side (down stream side of air flow A in FIG. 1) of the core unit 3. The terminal 9*e* is formed at the right side of the plus electrode 9*b*, and the terminal 9*f* is formed at the left side of the minus terminal 9*c*. Both terminals 9*e* and 9*f* may project toward the rear side (air flow direction A).

The terminals 9*e* and 9*f* are connected to an outside circuit (not shown) so that the electric heaters 9 can be energized by a vehicle electric source.

Reference numerals 12 and 13 indicate fastening members or bands made of anticorrosion metal respectively disposed on a surface of the air inlet side and on a surface of the air outlet side of the core unit 3. Each of the fastening members 12 and 13 has hook portions at the opposite ends thereof to engage grooves 8*c* and 8*d* formed at middle of the upper and lower side plates 8*a* and 8*b*. The fastening members 12 and 13 provides the support plates 10 and 11 with fastening force to hold the electric heater 9.

In assembling, the tubes 6 and corrugated fins 7 are alternately stacked on one another, and the support plates 10 and 11 are inserted between the corrugation summits of the corrugated fins 7 which are located in four hatched portions. In order to keep the distance between two plates 10 and 11, a dummy spacer (not shown) is inserted into the support plate 10.

The spacer is made of material (such as carbon) which is resistant to the soldering heat and is not soldered to aluminum. The tanks 1 and 2, the pipes 4 and 5 and the side plates 8*a* and 8*b* are also assembled in a well-known manner.

The above assembled unit is held by an assembling tool (not shown) and sent to a brazing furnace to be brazed or soldered. The assembled unit is heated at a soldering temperature (600° C.) to melt solder in aluminum clad members of the core unit 3.

Thereafter, the assembled unit is taken out from the furnace and is cooled until the temperature of the assembled unit goes down to the ambient temperature. Then, the flat heating element 9*a* is inserted between the electrodes 9*b* and 9*c* to form the three-layered sandwich unit, which is covered by the insulating cover 9*d*.

Thereafter, the dummy spacers are removed from the support plates 10 and 11, and each of the electric heaters 9 is inserted thereto in a manner that the insulating cover 9*d* is press-fitted to the support member 10. Thereafter, the hooks of the fastening members 12 and 13 are engaged with the grooves 8*c* and 8*d* of the upper and lower side plates 8*a* and 8*b* to fasten the core unit 3 tight.

In operation, when the passenger compartment is to be warmed, the motor-driven fan 15 is operated to pass air through the spaces between the flat tubes 6 and the corrugated fins 7 in the direction indicated by the arrow A in FIG. 1. On the other hand, a water pump (not shown) is operated and hot water flows into the inlet tank 1 from the inlet pipe 4.

The hot water is distributed to a plurality of flat tubes 6 and transfer the heat thereof to the air to be heated while the water flows along the flat tubes. All the water flowing along the flat tubes 6 are collected in the outlet tank 2 and goes out of the outlet pipe 5 to the engine.

When the temperature of the hot water of the engine is lower than a preset temperature (e.g. 80° C.), the electric source voltage of the vehicle is applied across the terminals 9*e* and 9*f* of the electrodes 9*b* and 9*c*. consequently, the heating elements 9*a* are energized to generate heat, which is conducted to the corrugated fins 7 via the electrodes 9*b* and 9*c*, the insulating cover 9*d* and the support plates 10 and 11. Therefore, the air is heated in a short time even if the water is not sufficiently hot.

Since the heating element 9*a* is composed of a PTC element which has a positive temperature characteristic the resistance of which increases sharply at a preset temperature T0, it regulates the temperature thereof to the preset temperature by itself.

Since the corrugated fins 7 and the support plates 10 and 11 are soldered beforehand, the solder melts in the subsequent soldering step of the core, is guided by the capillarity to the gaps between the summits of the corrugation of the corrugated fins 7 and support plate and fills the gaps even though the gaps forms due to irregular height of the corrugation.

The insulating cover 9*d* of the electric heater 9 can be made of adhesive resinous material to bond the electric heater 9 to the support plates 10 and 11. In this case, the fastening members can be omitted.

(Second Embodiment)

Figure 5:
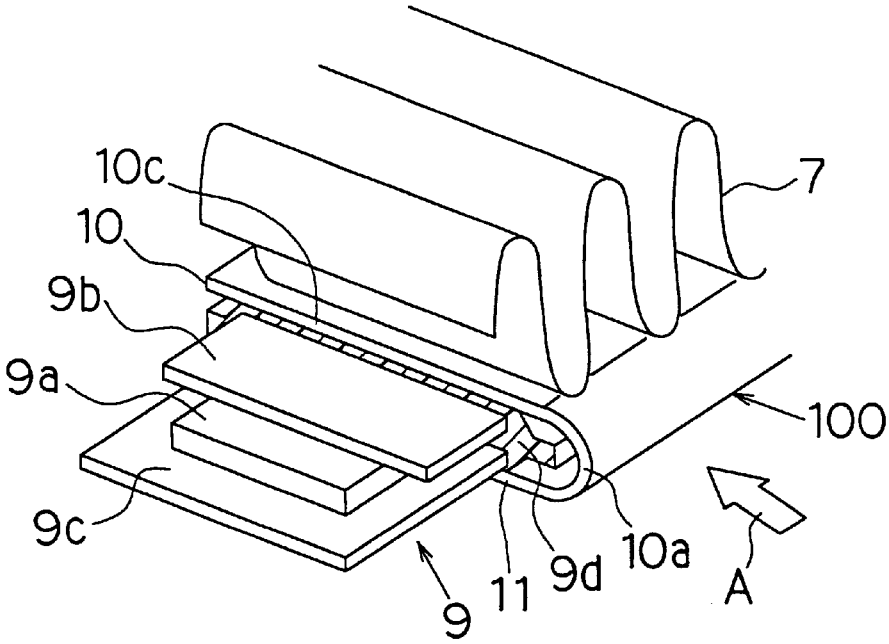
FIG. 5 is an enlarged perspective view of a portion where an electric heater of a heat exchanger according to a second embodiment of the present invention.

A second embodiment is described with reference to FIGS. 5–7. As shown in FIG. 5, each of the portions of the heat exchanger core unit 3 where the electric heaters are installed has a U-shaped support member 100 extending in the longitudinal direction of the flat tubes 6 between the summits of the corrugation of adjacent two of the corrugated fins. A U-shaped closing portion 10*a* of the support member 100 is located at the air inlet side of the heat exchanger core unit 3, and the opening portion 10*b* thereof is located at the air outlet side of the heat exchanger core unit 3.

The support member 100 has plates 10 and 11 extending in parallel at a distance L1, and they are soldered to the summits of the corrugations in the same manner as in the first embodiment. The electric heater 9 is inserted from the opening portion 10*b* into the inside of the support member 100 to be held therein. The electric heater 9 is held by an insulating member as described before.

Total thickness L2 of the support member 100 is same as thickness L3 of the flat tube 6 so that the support member 100 can be installed between the corrugated fins 7 instead of the flat tube 6. In FIG. 6, D is the thickness of the core unit 3 as well as the width of the flat tubes 6 and the corrugated fins 7 in the air flow direction.

Each of the support members 100 is made of a thin sheet having thickness between 0.1 and 0.5 mm and width (in the direction of the hot air) having nearly the same size as the core thickness D. The length (in the horizontal direction in FIG. 1) of the support member 100 is nearly the same as the distance between the sheet metals 1*b* and 2*b*.

Figure 6:
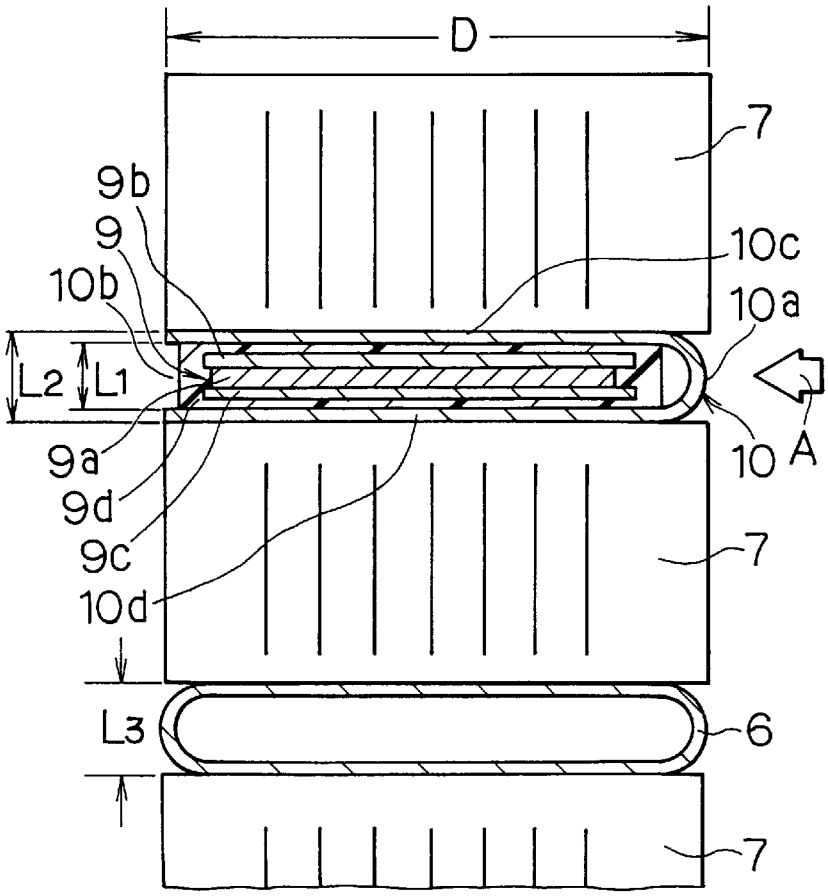
FIG. 6 is a cross-sectional view of the portion where the electric heater shown in FIG. 5 is installed.

The electric heater 9 has a three-layered sandwich structure composed of a flat heating element 9*a* and long flat electrodes 9*b* and 9*c* disposed on the opposite surfaces of the heating element 9*a* as shown in FIGS. 5 and 6. An insulating cover 9*d* covers the electrodes 9*b* and 9*c*. The heating element 9*a* is a PTC heater element which has a positive temperature characteristic to increase the resistance sharply at a prescribed temperature T0 (e.g. around 200° C.). The thickness of the heating element 9*a* is between 1.0–2.0 mm.

The electrodes 9*b* and 9*c* of the heating element 9*a* is made of aluminum, copper, stainless or the like and has the thickness between 0.1–0.5 mm. The length of the electrodes 9*b* and 9*c* (horizontal size in FIG. 1) is nearly equal to the length of the support member 100.

Since the support member 100 has the U-shaped closing portion 10*a*, the electric heater can be held by a single fastening member 12 disposed on the opening portions 10*b*.

Figure 7:
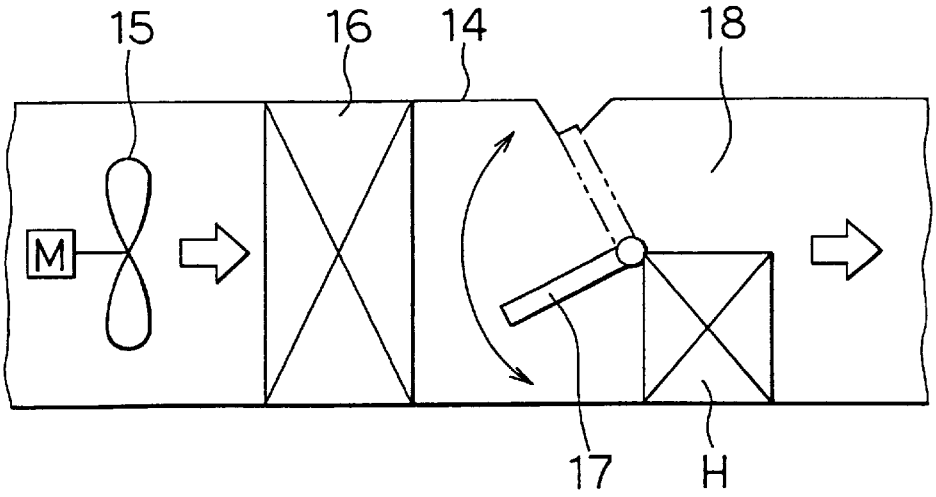
FIG. 7 is a schematic view illustrating air flow system of the vehicle air conditioner including the heat exchanger according to the second embodiment.

FIG. 7 illustrates an air conditioner to which a heat exchanger of a heater H according to this embodiment is installed. Outside air or inside air is introduced by a motor-driven fan 15 disposed in the upstream side of a resinous case 14 and sent to an evaporator 16 of the refrigerating cycle to be cooled and dried. The cooled air is separated by an air-mix door 17 into a flow passing the heat exchanger H for cooling air and a flow passing a bypass 18 so that the air heated by the heat exchanger H and the air passing the bypass 18 can be mixed and adjusted by turning the air-mix door 17, thereby controlling temperature of the air blown into the compartment of a vehicle.

The present invention can be applied to an air conditioner for a vehicle in which hot water supplied to the heat exchanger H is controlled by a hot-water control valve to control the temperature of the air blown into the vehicle compartment instead of the air-mix door 17.

In assembling, the heat exchanger core is assembled first. The tubes 6 and corrugated fins 7 are alternately stacked on one another, and one of the U-shaped support member 100 which extends along the tubes 6 is inserted between the corrugation summits of the corrugated fins 7 which are located in portions (four hatched portions). Other steps are substantially the same as those of the first embodiment.

In operation, when the passenger compartment is to be warmed, the motor-driven fan 15 is operated to pass air to be heated through the spaces between the flat tube and the corrugated fins. On the other hand, a water pump (not shown) is operated and hot water flows into the inlet tank 1 from the inlet pipe 4. The hot water is distributed to a plurality of flat tubes 6 and transfer the heat thereof to the air to be heated while the water flows along the flat tubes. All the water flowing along the flat tubes 6 are collected in the outlet tank 2 and goes out of the outlet pipe 5 to the engine.

When the temperature of the hot water of the engine is lower than a preset temperature (e.g. 80° C.), the electric source voltage of the vehicle is applied in the same manner as described before.

As shown in FIG. 7, the heat exchanger H for heating air is disposed at a downstream side of the heat exchanger 16 for cooling air in the case of the vehicle air conditioner. Therefore, condensed water generated in the heat exchanger 16 may be carried by the cooled air to the heat exchanger H and may adhere to the surface of the heat exchanger H. Snow may come from the air inlet into the case 14, melt and adhere to the upstream surface of the heat exchanger H.

The U-shaped closing portions 10*a* of the support member 100 are located at the air inlet side of the heat exchanger H, and the opening portions 10*b* are located at the air outlet side thereof. Even if the condensed water adheres to the upstream side of the heat exchanger H of the heater, the closing portions 10*a* keep off water or snow from the electric heater 9.

As shown in FIG. 6, the opening portion 10*b* projects a little from the downstream side of the electric heater 9. Even if water moves along the outer surface of the support members 100 to the opening portion 10*b*, the water can not adhere to the surface of the electric heater 9.

The electric terminals 9*e* and 9*f* of the electric heater 9 project from the downstream side of the heat exchanger core unit 3 in the air flow A, water does not adhere to the terminals 9*e* and 9*f*. Therefore, deterioration of the terminals 9*e* and 9*f*, short-circuiting and electric leakage can be prevented. Since the electric heaters 9 can be held in the U-shaped support members 100, the electric heater 9 can be positioned accurately.

Since the heating element 9*a* and the electrodes 9*b* and 9*c* of the electric heater 9 are covered by the insulating cover 9*d* and insulated from the support plate 10, electric current can not flow into the metal members of the heat exchanger H, and the electric corrosion of the metal members such as tubes or fins can be prevented.

Figure 8:
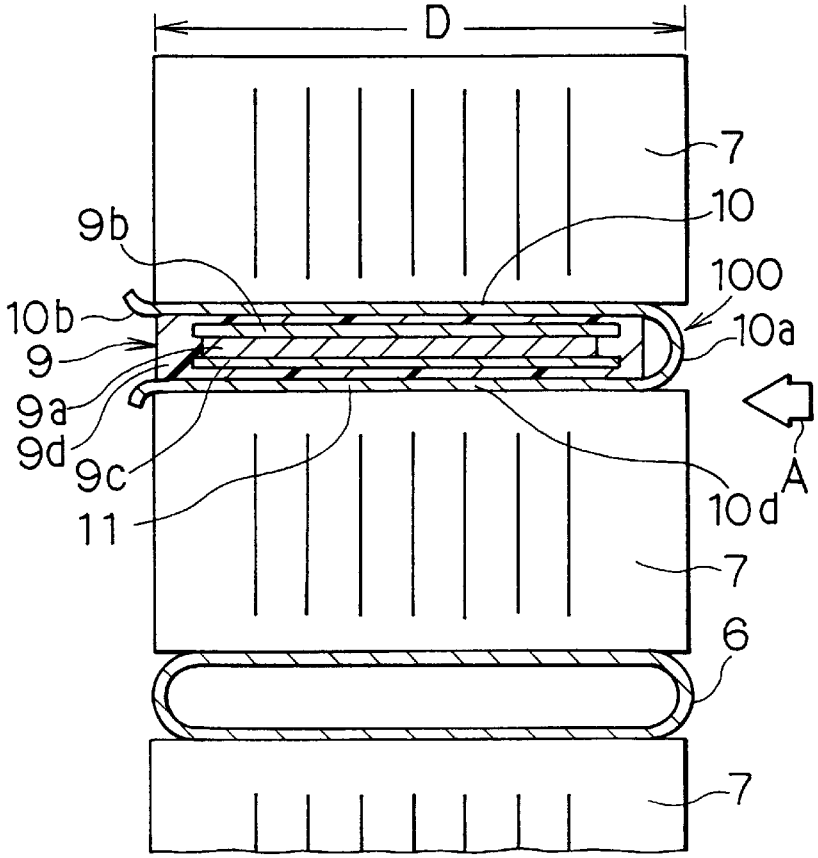
FIG. 8 is a cross-sectional view of a variant of the electric heater according to the second embodiment of the present invention.

FIG. 8 shows a variant of the second embodiment. The opening portion 10*b* of the support member 100 projects slightly from the end of the electric heater 9. The opening portion 10*b* is positioned at the downstream side of the corrugated fins in the air flow and is expanded at the end thereof like a skirt. Accordingly, the water moving along the surface to the opening portion 10*b* of the support member 100 is prevented from adhering to the electric heater with more confidence.

Figure 9:
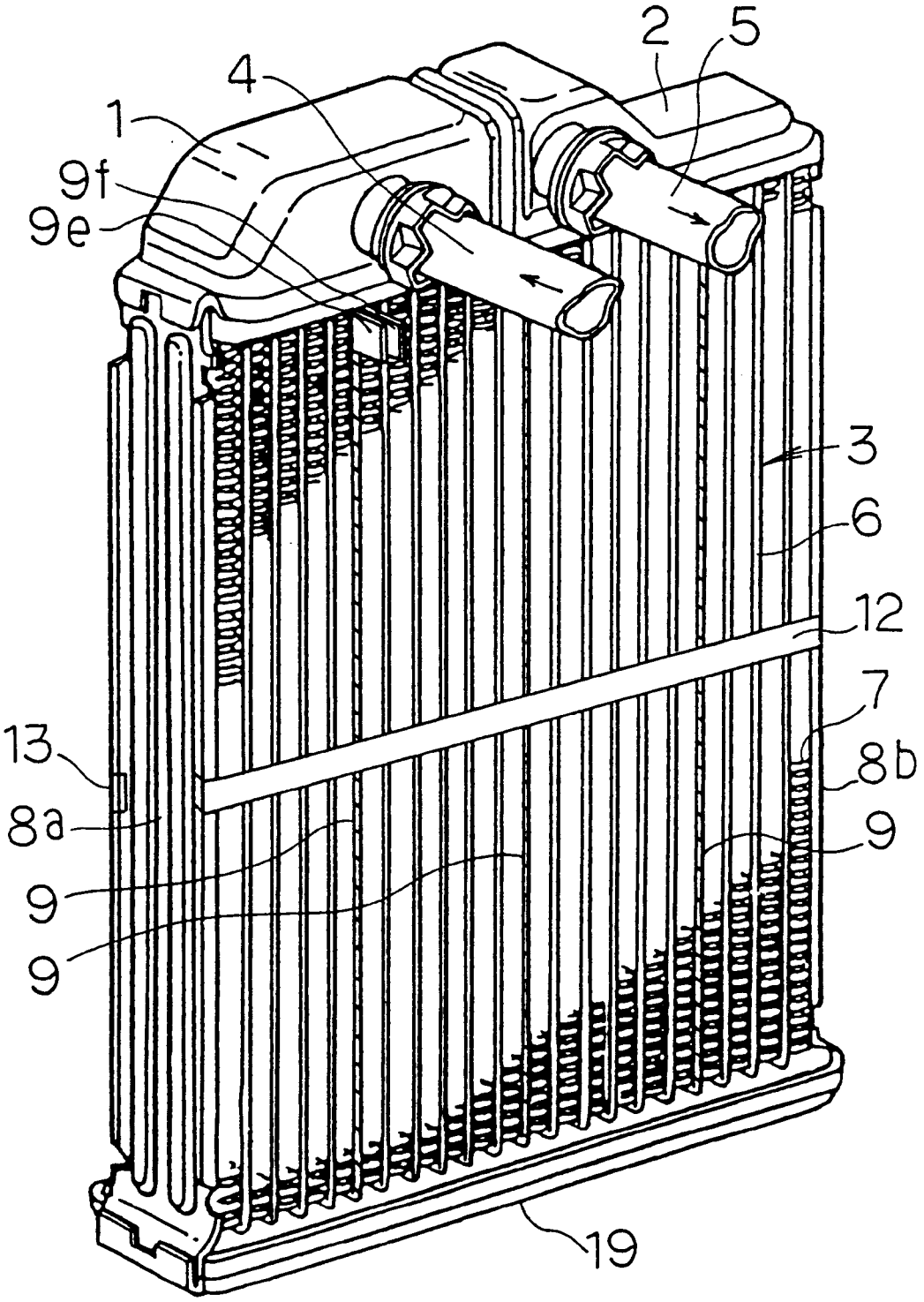
FIG. 9 is a perspective view of a second variant of the heat exchanger of an electric heater according to the second embodiment of the present invention.

FIG. 9 shows a second variant of the second embodiment. The heat exchanger H according to the second variant is a type in which hot water is returned as compared with the heat exchanger H according to the first embodiment, so called full-pass (one way) type, in which the hot water flows in one direction in all the flat tubes from the hot water inlet tank 1 to the hot water outlet tank 2. In other words, the tank disposed on a side of the core unit 3 is divided into the hot water inlet tank 1 and the hot water outlet tank 2, and a connecting tank 19 is disposed to return the water to the opposite side of the tanks 1 and 2. Hot water is introduced from the inlet tank 1 through the flat tubes 6 on the left side of the core unit 3 into the connecting tank 19. From the connecting tank 19, the hot water is introduced to the outlet tank 2 through the flat tubes 6 on the right side of the core unit 3 and goes out from the outlet 5. The electric heater 9 can be installed in this type in the same manner as in the first embodiment.

Figure 10:
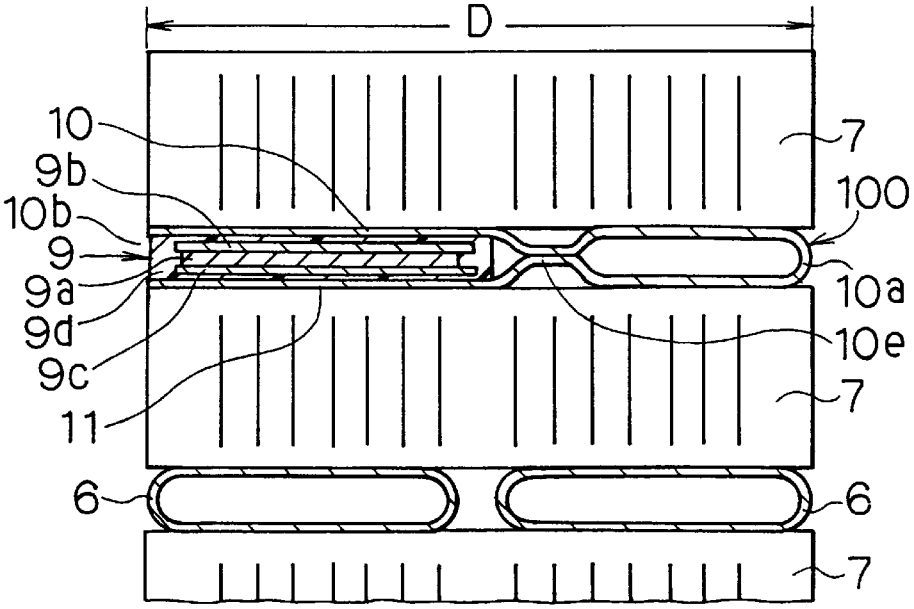
FIG. 10 is a cross-sectional view of a third variant of the electric heater according to the second embodiment.

FIG. 10 shows a third variant of the second embodiment. Two rows of the flat tubes 6 are disposed in the thickness of the core and, therefore, the thickness D of the core unit 3 is about twice as thick as the thickness of electric heater. A stopper portion 10*e* is formed at the middle of the support member 100 to hold the electric heater 9 in position. The middle portions of the support member 100 are pinched to be in contact with each other. Thus, the same electric heater 9 can be used to any heat exchanger H of a heater having core with different thickness.

Figure 11:
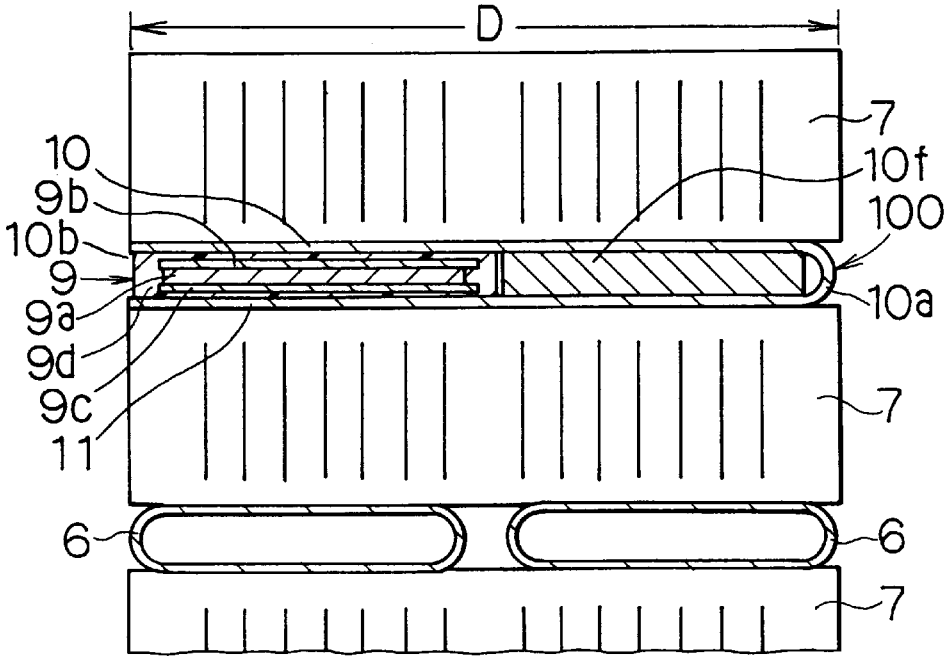
FIG. 11 is a cross-sectional view of a fourth variant of the electric heater according to the second embodiment.

FIG. 11 shows a fourth variant of the second embodiment. A separate stopper member (made of resin or metal) 10*f* is disposed inside the support member 100.

Figure 12:
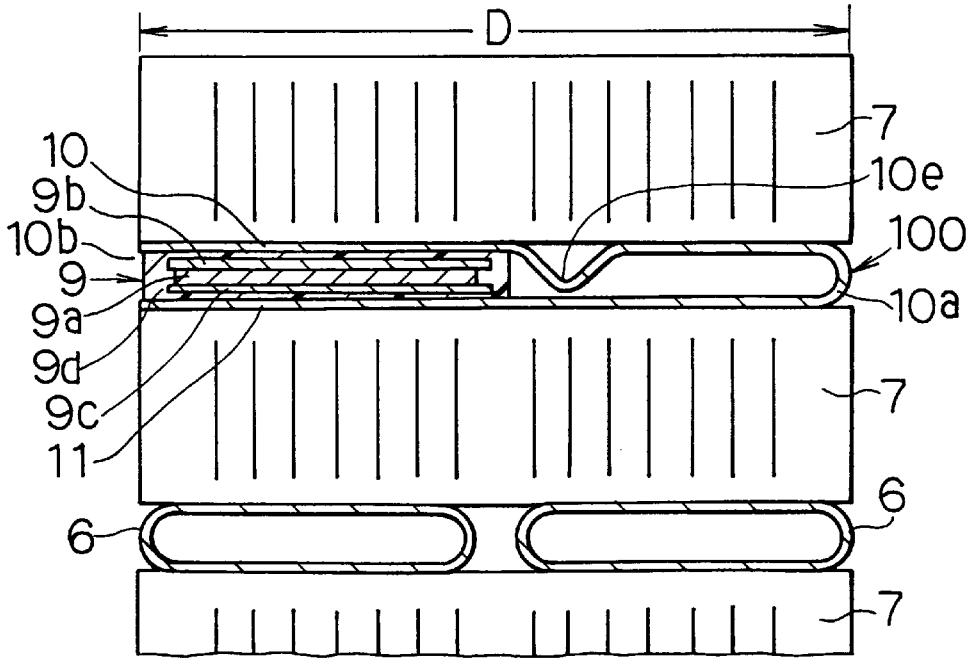
FIG. 12 is a cross-sectional view of a fifth variant of the electric heater according to the second embodiment.

FIG. 12 shows a fifth variant of the second embodiment. The plate 10 of the support member 100 is pinched to form the stopper 10*e*.

Figure 13:
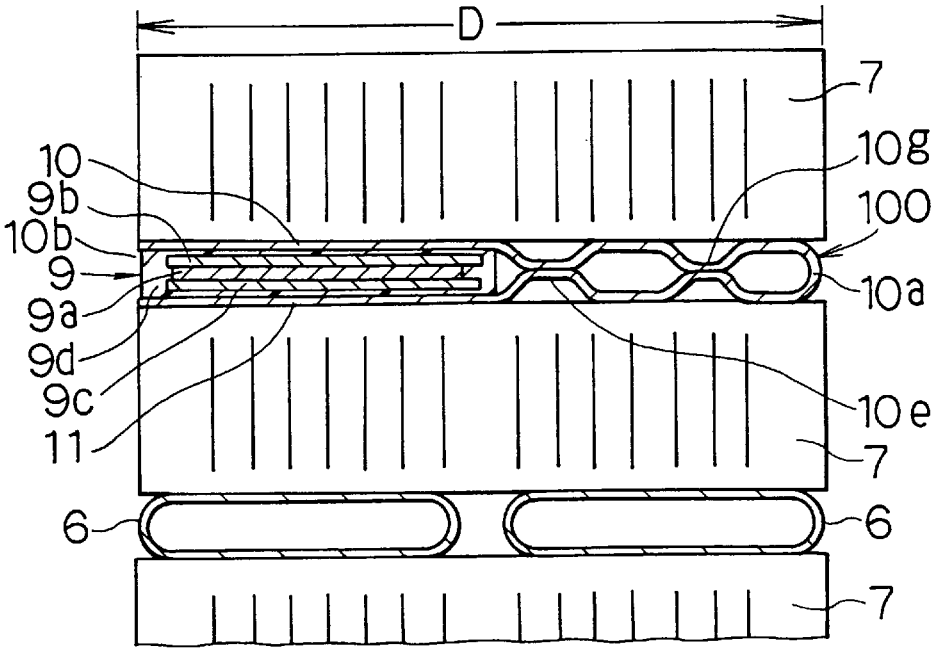
FIG. 13 is a cross-sectional view of a sixth variant of the electric heater according to the second embodiment.

FIG. 13 shows a sixth variant of the second embodiment. The support member 100 has a reinforcement rib 10*g* between the stopper portion 10*e* and the closing portion 10*a*. The reinforcement rib 10*g* is formed by pinching middle portions of the plates 10 and 11. The reinforcement rib 10*g* increases the stiffness of the portion between the stopper portion 10*e* and the closing portion 10*a*. The reinforcement rib 10*g* of the seventh embodiment can be formed on either one of the two plates 10 and 11.

The stopper 10*e* and the reinforcement rib 10*g* can be formed along the whole length of the tubes of the core continuously or intermittently

[Third Embodiment]

Figure 14:
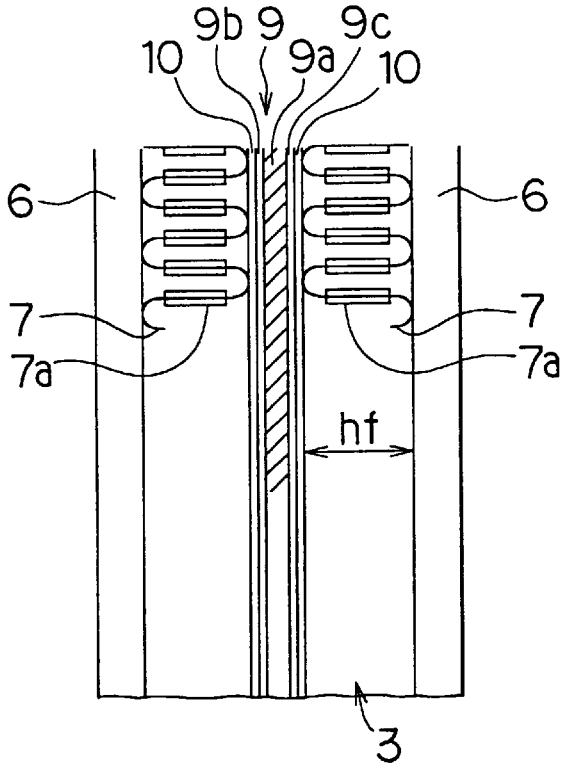
FIG. 14 is a schematic view illustrating a main portion of Ad a heat exchanger core unit according to a third embodiment of the present invention.

The PTC heater 9 shown in FIG. 14 is composed of a flat heating element 9*a* and long flat electrodes 9*b* and 9*c* disposed on the opposite surfaces of the heating element 9*a*. The heating element 9*a* is a PTC heater element which has a positive temperature characteristic to increase the resistance sharply at a prescribed temperature T0.

The electrodes 9*b* and 9*c* of the PTC heater element 9*a* are bonded by adhesive insulating material 10 to the summits of corrugation of the corrugated fins 7. The opposite ends of the PTC heater element 9*a* (horizontal direction in FIG. 1) are bonded by adhesive insulating material 10 to the sheet metals 1*b* and 1*c*. The adhesive insulating material 10 is made of adhesive, electrically insulating and heat conductive resin. Heat generated by the PTC heater element 9*a* is conducted by the corrugated fins 7 to heat the heating air.

Figure 15:
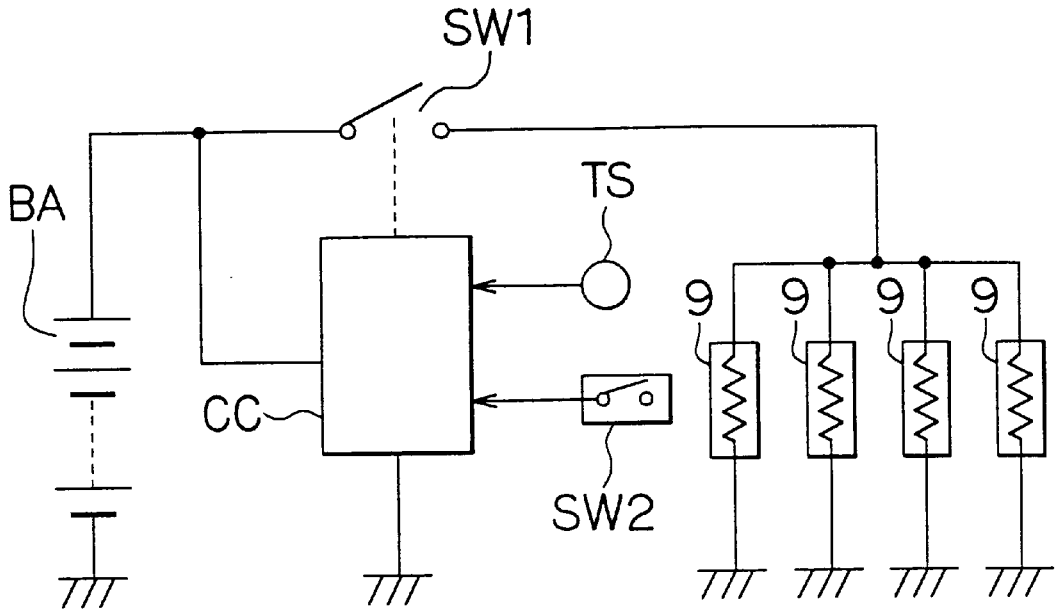
FIG. 15 is a driving circuit diagram for the PTC heater integrated in the core unit shown in FIG. 14.

FIG. 15 shows an electric driving circuit of the PTC heater 9. The four PTC heaters 9 are parallelly connected to a vehicle electric source BA via a switch SW1. The switch SW1 is controlled by a control circuit CC. The control circuit CC receives signals from a water temperature sensor TS for detecting temperature of the water flowing from the engine into the heat exchanger of a heater and a switch SW2 operated when the heater operates. If the water temperature is lower than a certain temperature (e.g. 80° C.), the control circuit CC turns on the switch SW1 to power the PTC heaters 9.

In operation, an air blower operates and drives air to the spaces between the flat tubes 6 and the corrugated fins 7. On the other hand, hot water is driven by a water pump (not shown) installed in the engine to flow from the engine through the inlet pipe 4 into the inlet tank 1. Then, the hot water is distributed into a plurality of the flat tubes 6 to heat the heating air via the corrugated fins while passing the tubes 6. Thereafter, the hot water flows into the outlet tank 2, gets together, flows out of the outlet pipe 5 of the heat exchanger and returns to the engine.

If the temperature of water flowing out of the engine is low, the switch SW1 of the electric circuit closes to power the four PTC heaters 9. The PTC heaters 9 self-controls the temperature and rises to the temperature T0, which is transmitted to the heating air through the adjacent corrugated fins 7. Thus, the heating air is heated in a short time even if the water temperature is low.

In order to utilize the heat generated by the PTC heater 9 effectively, the set temperature T0 is an important factor.

Figure 16:
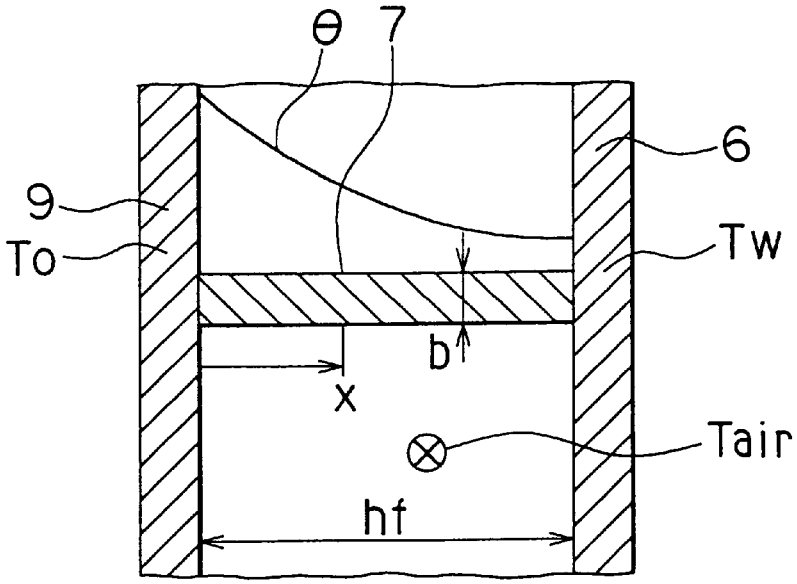
FIG. 16 is a schematic diagram showing temperature distribution of the corrugated fin adjacent to the PTC heater shown in FIG. 15.

FIG. 16 shows temperature distribution of the corrugated fin 7 disposed between the surface of the PTC heater 9 and the surface of the adjacent flat tube 6.

The following relations expressed by E1 and E2 are known, where temperature of the heating air flowing in the direction vertical to the drawing is Tair, set temperature (surface temperature) of the PTC heater 9 is T0, height of the corrugated fin 7 is hf, height of a certain position of the corrugated fin 7 is x, and temperature of the fin at the height x of the certain position is θ:

$$(\theta-\mathrm{Tair})/(\mathrm{T0}-\mathrm{Tair})=\cosh[m(\mathrm{hf}-x)]/\cosh(m\cdot\mathrm{hf}) \quad \text{E1:}$$

$$\theta=\cosh[m(\mathrm{hf}-x)]/\cosh(m\cdot\mathrm{hf})\times(\mathrm{T0}-\mathrm{Tair})+\mathrm{Tair}, \quad \text{E2:}$$

where m is a dimensionless number expresses in the following expression E3.

$$m=\sqrt{2h_0/\lambda f\cdot b}, \quad \text{E3:}$$

where $h_0$ is a coefficient of heat transfer of the fin surface, b is a thickness of the fin, and λf is a coefficient of heat conductivity of the fin material.

In order to utilize the heat generated by the PTC heater 9 effectively, the temperature θ of the portions of the corrugated fins 7 adjacent to the flat tubes 6 (the portions at x=hf) is made equal to the temperature Tw of the peripheral surface of the tubes (or the water temperature in the tubes) in order to prevent the heat generated by the PTC heater 9 from transferring to the water.

If x=hf, and θ=Tw, the expression E1 is expressed by the following expression E4.

$$(\mathrm{Tw}-\mathrm{Tair})/(\mathrm{T0}-\mathrm{Tair})=1/[\cosh(m\cdot\mathrm{hf})] \quad \text{E4:}$$

The set temperature T0 of the PTC heater 9 to satisfy the above condition can be obtained from the following expression E5.

$$\mathrm{T0}=(\mathrm{Tw}-\mathrm{Tair})\cosh(m\cdot\mathrm{hf})+\mathrm{Tair} \quad \text{E5:}$$

Figure 17:
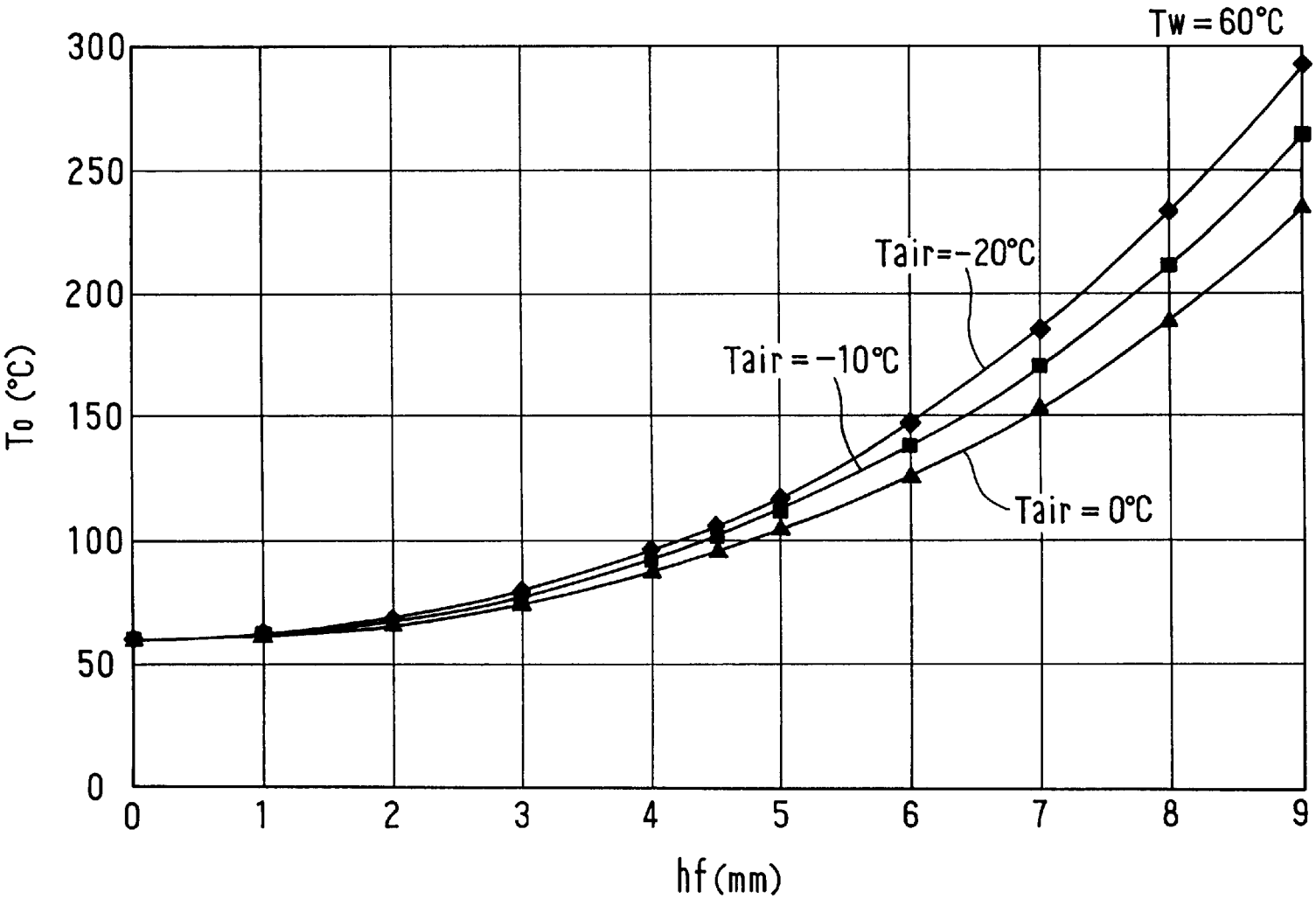
FIG. 17 is a graph showing relationship between the set temperature of the PTC heater and the height of the corrugated fins at water temperature of 60° C.

FIG. 17 shows relationship between the height hf of the fin and the set temperature T0 of the PTC heater 9 with various heating air temperatures Tair under the following conditions:

the heating air temperature Tair Tw=60° C., $h_0$=300 W/m$^2$ K, b=0.06 mm, λf=193 W/m K (fin material:A3003).

Thus, m is calculated by the expression E3 as follows:

m=227.626

In the air conditioner for a vehicle, outside dry air is introduced to the heater in order to prevent frosting of the windshield glass. Therefore, Tair is the outside temperature in winter. Because a recent highly-efficient-engine can provide hot water of 60° C. at the highest in winter, 60° C. is selected as Tw.

Figure 18:
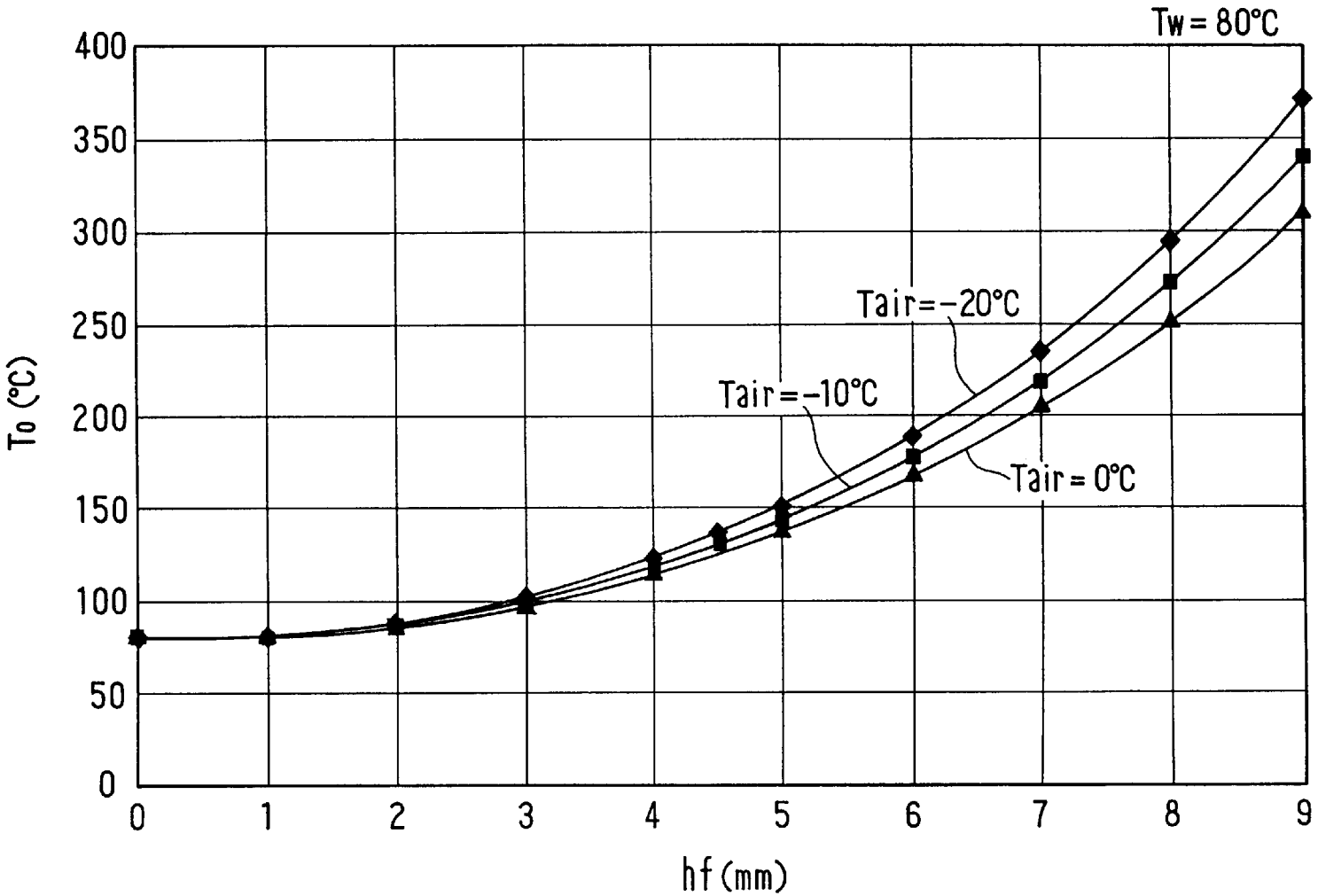
FIG. 18 is a graph showing relationship between the set temperature of the PTC heater and the height of the corrugated fins at water temperature of 80° C.

FIG. 18 shows relationship between the height hf of the fin and the set temperature T0 of the PTC heater 9 with various heating air temperatures Tair when Tw is 80° C. under the same conditions as above.

Figure 19:
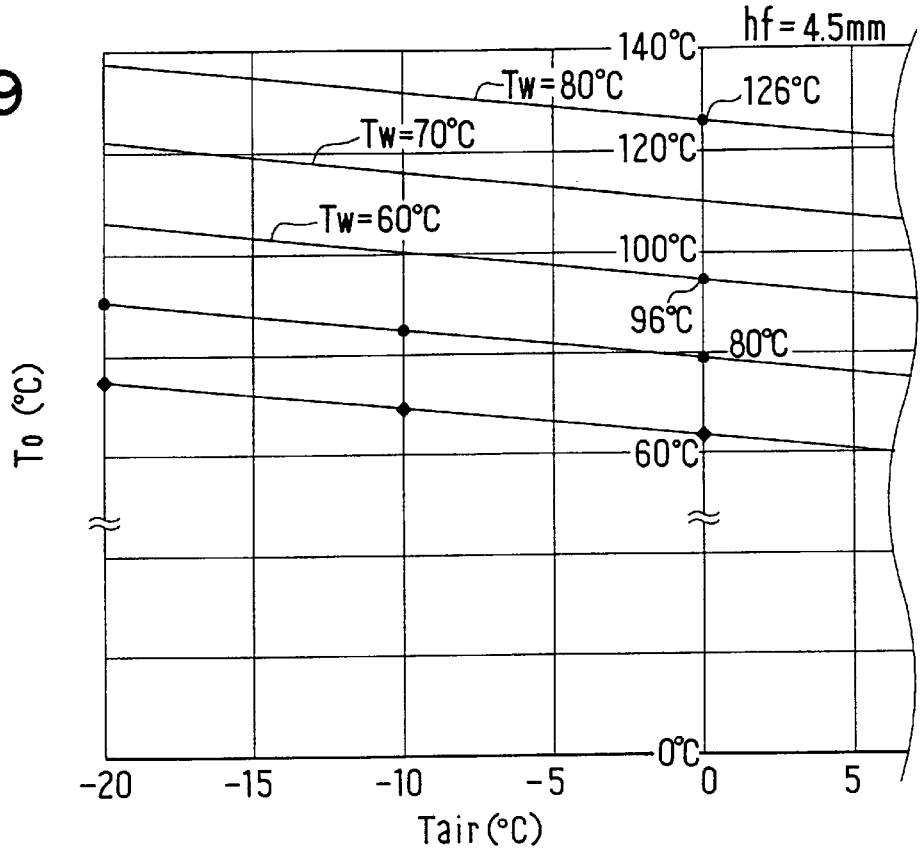
FIG. 19 is a graph showing relationship between the set temperature of the PTC heater and the temperature of the heating air with the height of the fins being 4.5 mm.

FIG. 19 shows relationship between the set temperatures T0 and the heating air temperatures Tair at various water temperatures Tw with the height of the corrugated fins being 4.5 mm. When the water temperature Tw changes from 60° C. to 80° C. and the heating air temperature Tair is 0° C. or lower, the set temperature of the PTC heater 9 changes from 96° C. to 126° C.

Figure 20:
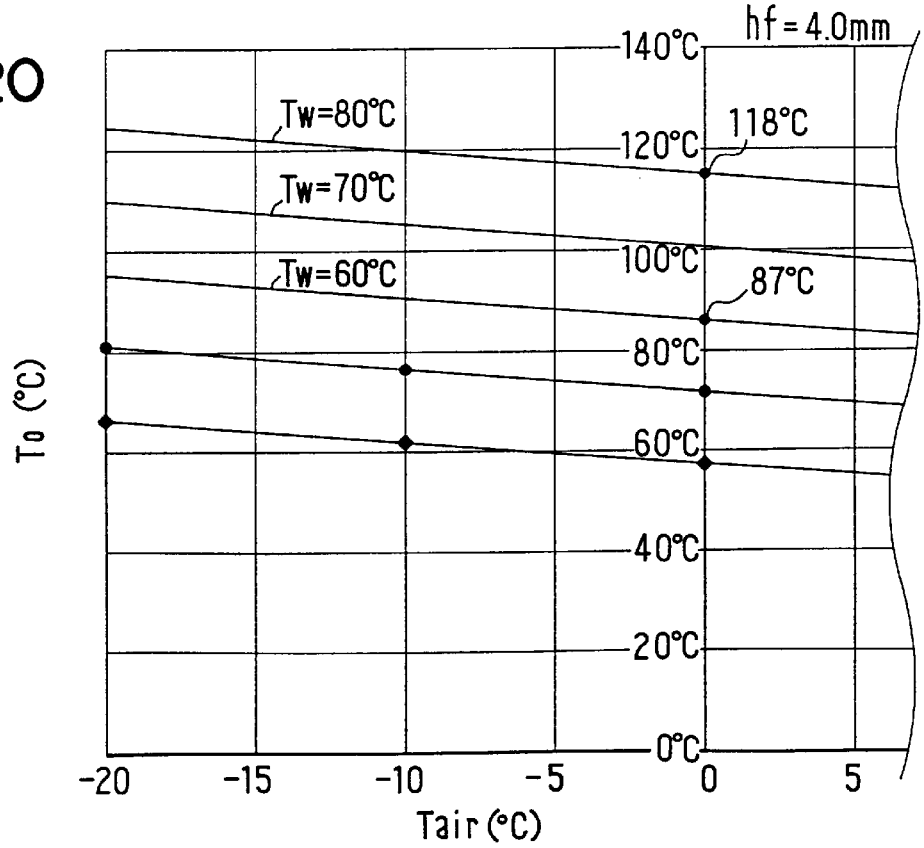
FIG. 20 is a graph showing relationship between the temperature of the PTC heater and the temperature of the heating air with the height of the fins being 4.0 mm.

FIG. 20 shows relationship between the set temperatures T0 and the heating air temperatures Tair at various water temperatures Tw when the height of the fins hf is 4.0 mm. When the water temperature Tw changes from 60° C. to 80° C. and the heating air temperature Tair is 0° C. or lower, the set temperature of the PTC heater 9 changes from 87° C. to 118° C.

Figure 21:
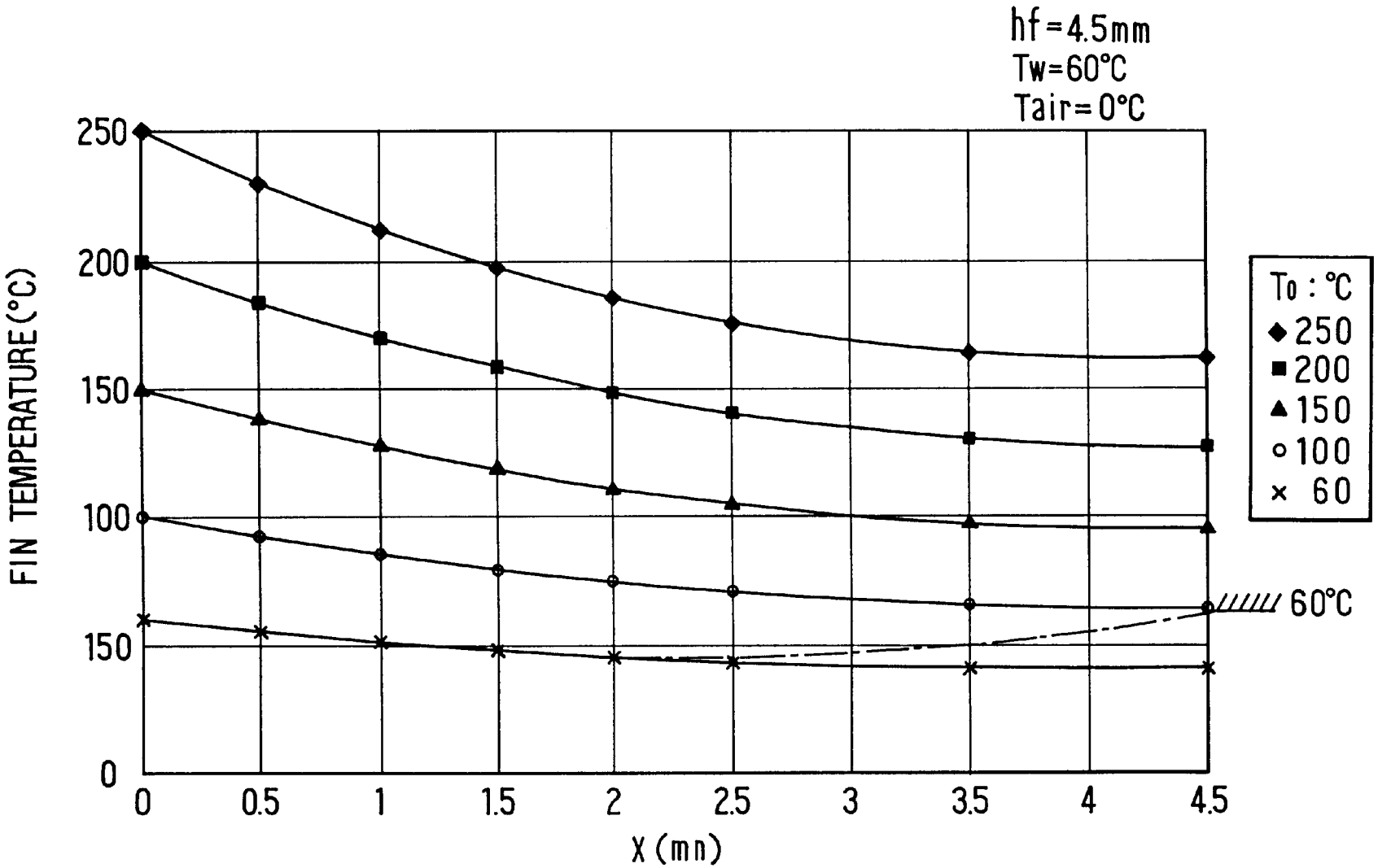
FIG. 21 is a graph showing temperature distribution of the corrugated fin.

FIG. 21 is a graph showing relationship between temperatures on the fin surfaces and distances x of the fin surfaces from the PTC heater 9 with following conditions:

The height hf is 4.5 mm, the water temperature Tw is 60° C., and the heating air (outside air) temperature Tair is 0° C.

If the set temperature T0 of the PTC heater 9 is higher than 100° C., the temperature of the portions (at x=4.5 mm) of the corrugated fins 7 adjacent to the flat tubes 6 becomes higher than the temperature Tw (60° C.) of the water in the flat tubes 6. In this case, the heat of the corrugated fins, which is transferred from the PTC heater 9, is transferred to water and the heat generated by the PTC heater 9 is not utilized efficiently.

In the heat exchanger of a heater for a vehicle, the shorter width of the elliptic opening of the flat tube 6 is about 1.4 mm. It is found preferable that the height of the corrugated fins 7 is equal to or larger than 3.9 mm in combination with the above sized tubes. If the height of the fins is less than 3.9 mm, the ratio of the heat conduction area of the corrugated fins to the number of the flat tubes 6 is too small to have a sufficient heat radiation capacity. The height hf of the fins is, preferably, smaller than 5 mm. Otherwise, temperature of the middle portions of the corrugated fins becomes excessively lower than the temperature of the portions of the corrugated fins 7 adjacent to the tubes. This reduces the difference between the fin temperature, and the heating air temperature becomes too small for efficient heat transfer. Thus, the desirable height hf of the corrugated fins 7 is between 3.9 and 5.0 mm.

In FIG. 17, when the heating air (outside air) Tair is 0° C., the set temperature T0 of the PTC heater 9 is between 80° C. and 120° C. if the height hf of the fins being between 3.9 and 5.0. In order to provide the above set temperature in this embodiment, the heater element 9*a* has positive temperature characteristic sharply changing the resistance thereof at temperature between 120° C. and 170° C.

(Fourth Embodiment)

Figure 22:
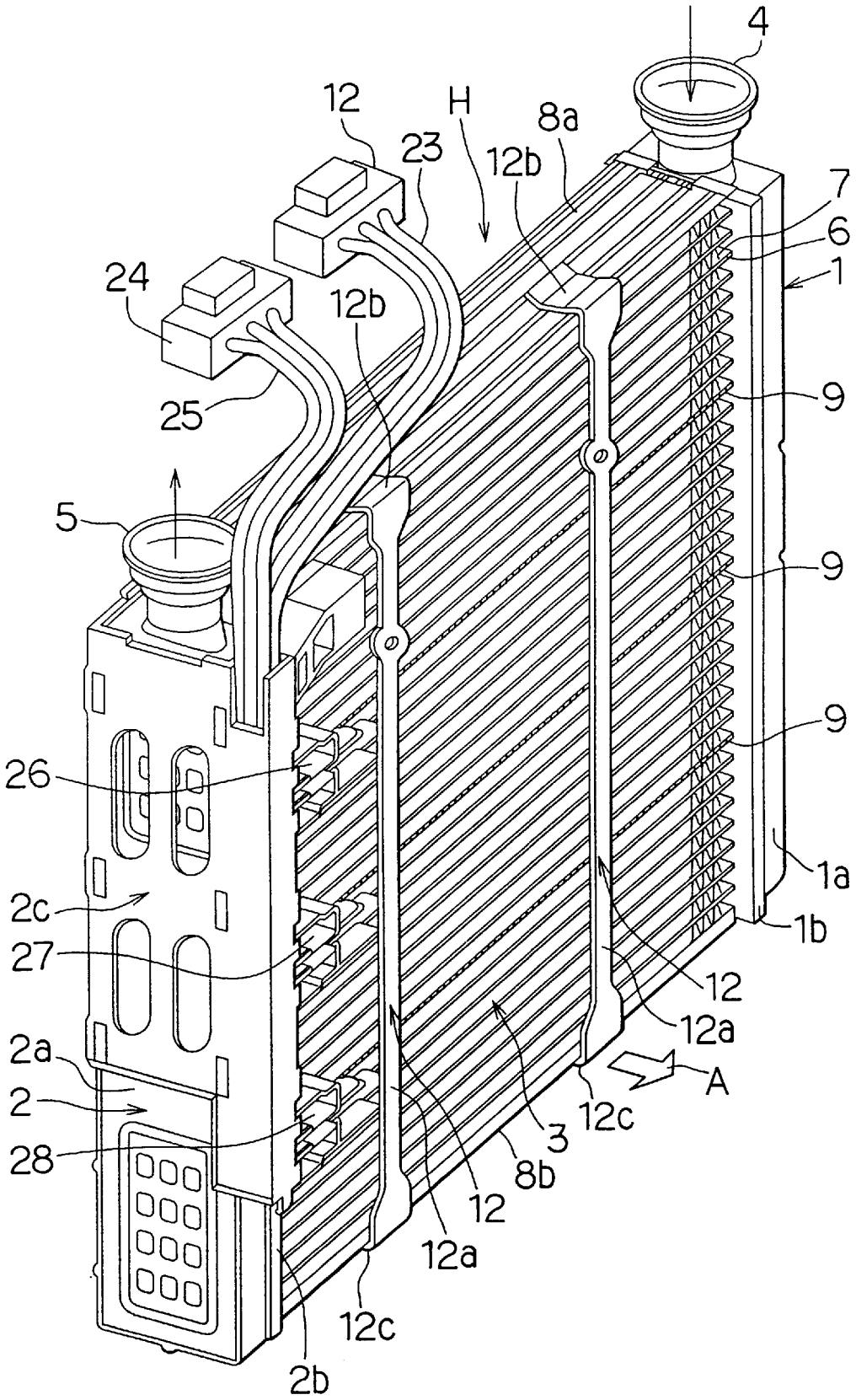
FIG. 22 is a perspective view illustrating a heat exchanger according to a fourth embodiment of the present invention.

In FIG. 22, a heat exchanger H for a heater, according to a fourth embodiment of the invention, has a hot-water inlet tank 1, a hot-water outlet tank 2 and a heat exchanger core unit 3 disposed between the tanks 1 and 2. The hot-water inlet tank 1 has an inlet pipe 4 through which hot water or engine coolant flows from a vehicle engine (not shown). The hot-water outlet tank 2 has an outlet pipe 5 through which the hot water is discharged and returned to the engine. The heat exchanger is symmetrical, and therefore the hot-water inlet tank 1 and the hot-water outlet tank 2 can be exchanged. Thus, the heat exchanger H is almost the same in basic construction, and, therefore, portions different from the first embodiment is described hereafter.

The electric heater 9 has the same three-layered sandwich structure as described with reference to FIGS. 3A–3D. The heating element 9*a* is a PTC heater element made from resistance material (such as barium titanate), which has a positive temperature characteristic increasing the resistance sharply at a set around 200° C.

An electric wire cover 2*c* is fixed to the outlet tank 2. The wire cover 2*c* is a flexible member made of resinous material such as polypropylene covering peripheral portion of the outlet tank. The wire cover 2*c* has a detachable member for elastically engaging with a portion of the outlet tank 2 and three terminal portions 26, 27, and 28. A positive connector 22 with its three lead wires 23 and a negative connector 24 with its three lead wires 25 are respectively connected, at the three terminal portions 26, 27 and 28, to the electrodes 9*b* and 9*c* of the PTC heater element 9*a* via connection members (not shown) and held by the wire cover 2*c*. The positive and negative connectors 22 and 24 are connected to an outside control circuit (not shown) so that electric power can be supplied to the electric heaters 9.

A pair of elastic fastening members 12 are located at the air outlet side of the core unit 3. Each of the fastening members 12 has hook portions 12*b* at the opposite ends thereof to engage grooves of the side plates 8*a* and 8*b*. Thus, the pair of fastening members 12 are disposed between upper and lower side plates 8*a* and 8*b*, so that the fastening members 12 can provide the support plates 10 and 11 with force to hold the electric heater 9. The number of the fastening members 12 can be reduced to one, or increased to three according to circumstances of the heat exchanger in use.

Figure 23A:
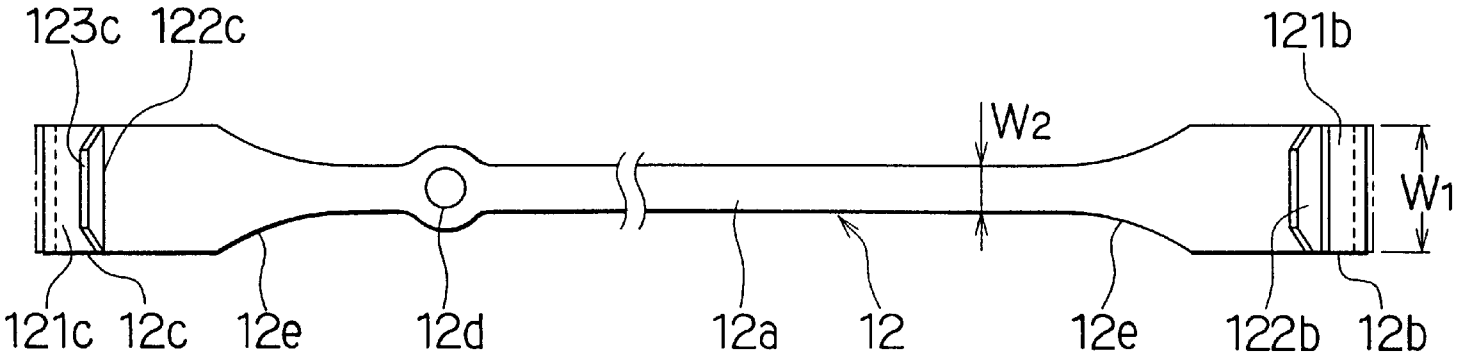
FIGS. 23A, 23B and 23C are respectively a plan view, a front view and a side view of a fastening member according to the fourth embodiment.
Figure 23B:
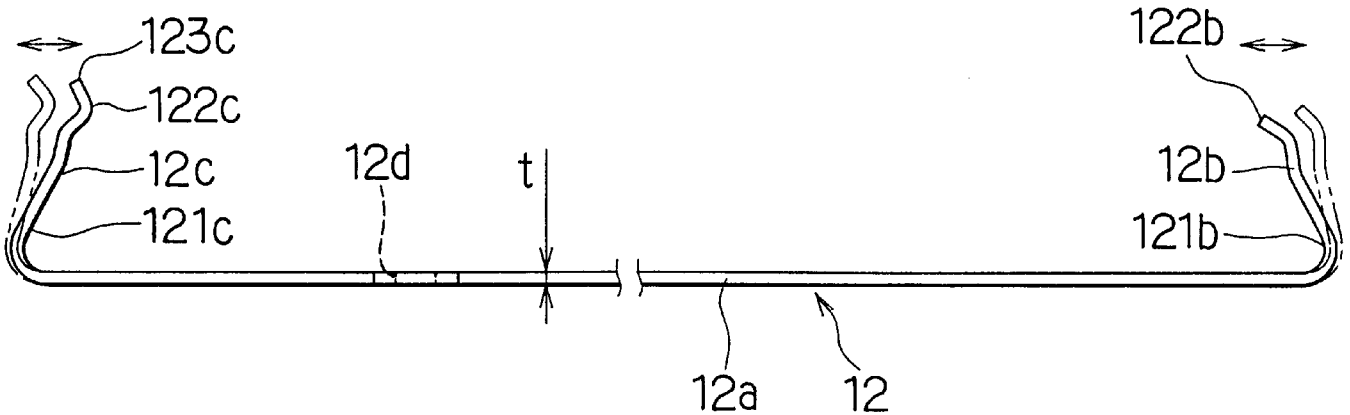
Figure 23C:
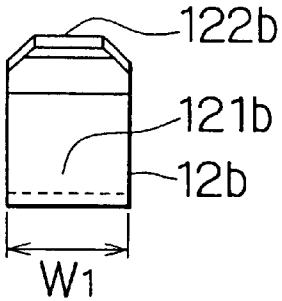

The fastening member 12 is made of a thin steel plate that is as thick as about 1 mm and has a slender band portion 12*a*, a pair of hook portions 12*b* and 12*c*, and a hole 12*d*, as shown in FIGS. 23A and 23B. The pair of hook portions 12*b* and 12*c* is as wide as about 10 mm, and the band portion 12*a* is as wide as about 4 mm. In other words, the width W2 of the band portion 12*a* is less than one half (½) of the width W1 of the hook portion 12*b* or 12*c*. This reduces a draft resistance or draft loss of air passing through the core unit 3. The pair of hook portions 12*b* and 12*c* is connected to the band portion 12*a* by neck portions 12*e* having gradually narrowing arc-shaped or tapering sides.

The hook portion 12*b* or 12*c* has an arc-shaped portion 121*b* or 121*c*. The hook portion 12*b* has a nail portion 122*b* which extends further inward. On the other hand the hook portion 12*c* has an inward projection 122*c* and a guide portion 123*c* which extends axially outward.

Figure 24:
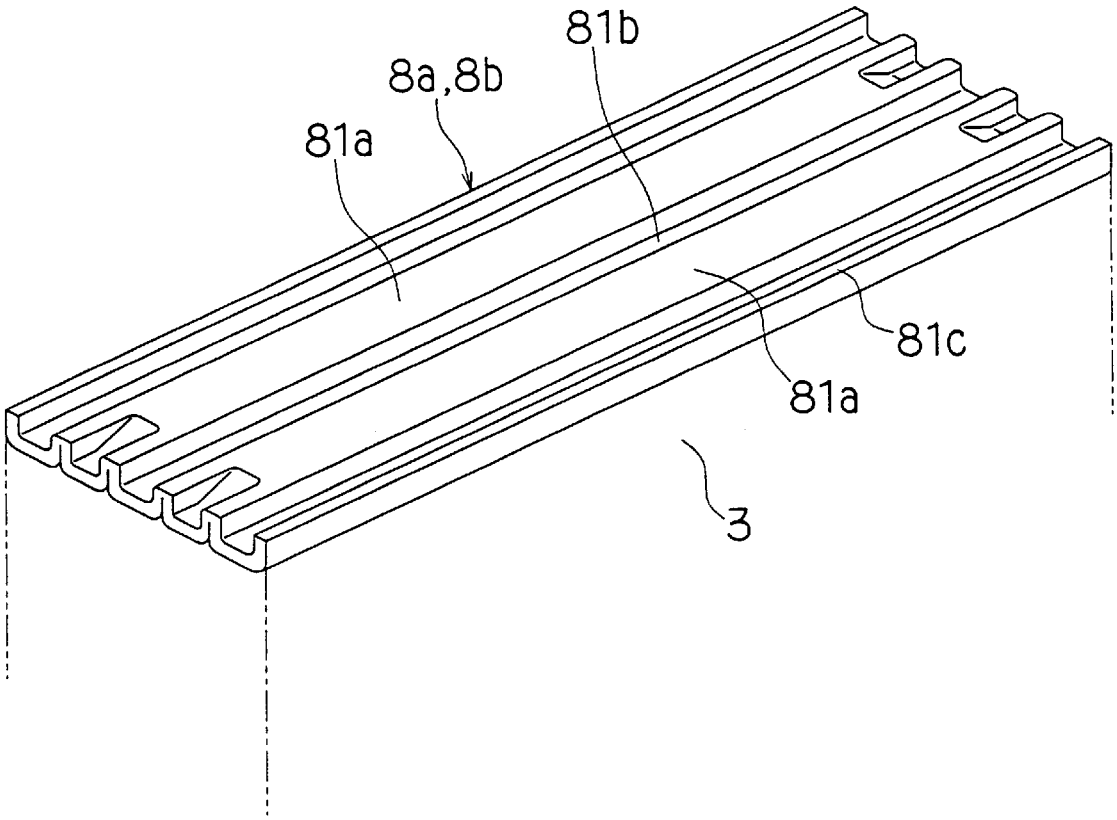
FIG. 24 is a perspective view of a side plate shown in FIG. 22.

As shown in FIG. 24, each of the side plates 8*a* and 8*b* has longitudinally extending reinforcement ribs 81*a* forming grooves 81*b* therebetween. The reinforcement ribs 81*a* prevent the corrugated fins 7 from buckling.

The hole 12*d* is formed to be engaged with a hanger of a transfer machine of a plating process for plating the fastening members 12 with anticorrosion metal.

Figure 25:
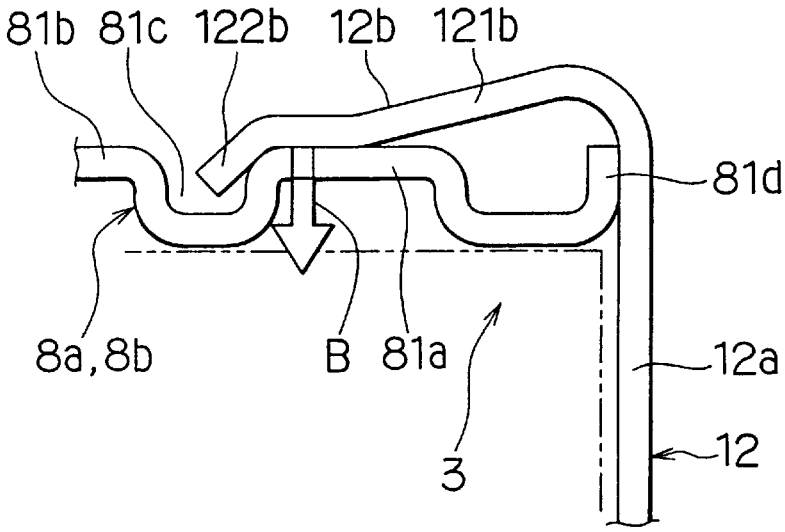
FIG. 25 is a fragmentary enlarged view of the side plate and a portion of the fastening member in engagement.

The hook portion 12*b* of the pair of fastening members 12 is put on the upper side plate 8*a* so that the nail portion 122*b* can be fitted to one of the grooves 81*b* as shown in FIG. 25. Then, the hook portion 12*c* thereof is brought to the lower side plate 8*b* so that the inward projection 122*c* can be guided by the guide portion 123*c* and fitted into one of the grooves 81*b* of the lower side plate 8*b*. As a result, the fastening force of the fastening member 12 is applied to one of the rib 81*a* of the core unit 3 as indicated by an arrow B. Because of the elasticity of the hook portions 12*b* and 12*c* as shown in FIG. 23B, the fastening members 12 can hold the core unit 3 tight irrespective of variations in size thereof. This provides a high productivity.

The heat exchanger H according to the fourth embodiment is assembled almost in the same manner as the heat exchanger according to the first embodiment.

(Fifth Embodiment)

Figure 26A:
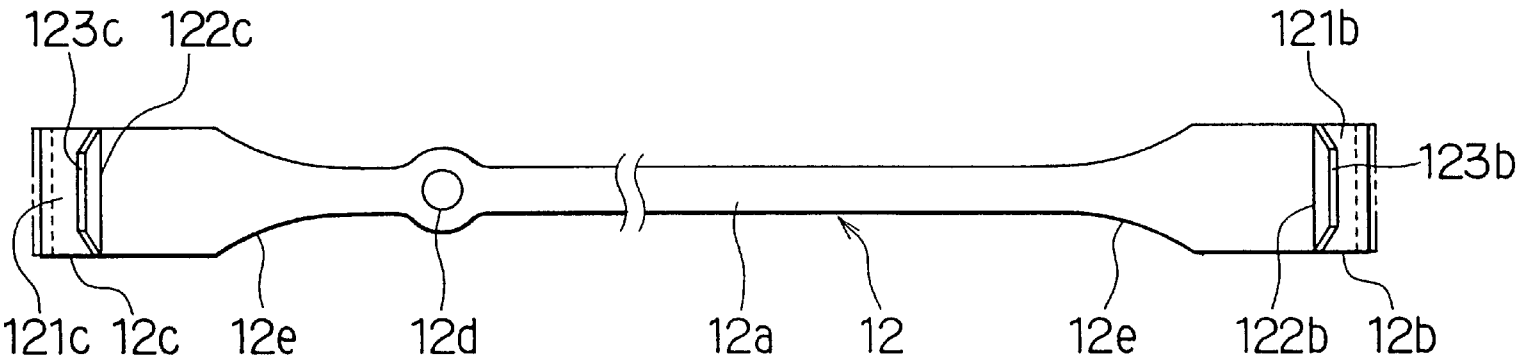
FIGS. 26A, 26B, and 26C illustrate a fastening member according to a fourth embodiment of the present invention.
Figure 26B:
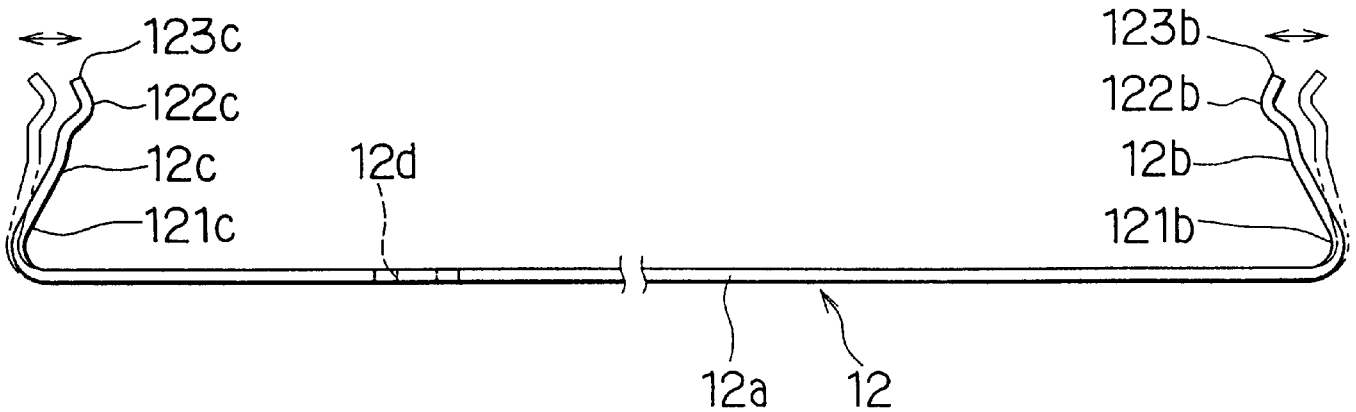
Figure 26C:
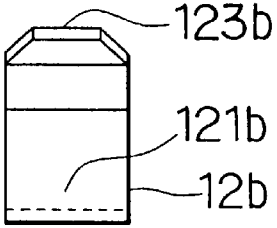

As shown in FIGS. 26A and 26B, The hook portions 12*b* of the fastening member 12 is the same in shape as the hook portion 12*c*. Therefore, it is not necessary to distinguish one hook portion from the other.

(Sixth Embodiment)

Figures 27A, 27B, 27C:
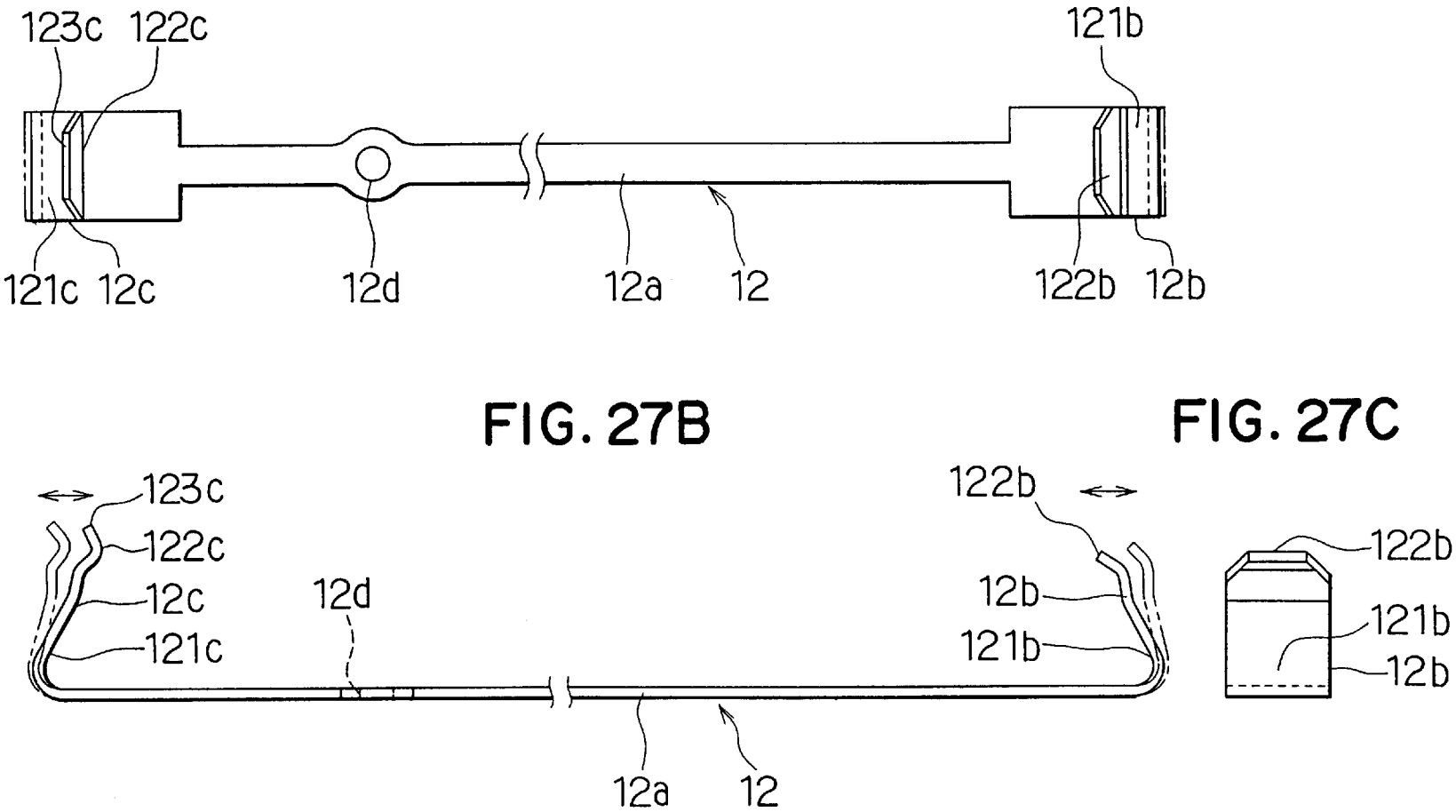
FIGS. 27A, 27B and 27C illustrate a fastening member according to a fifth embodiment of the present invention.

As shown in FIGS. 27A and 27B, the neck portion 12*e* is removed to reduce the draft resistance a little more.

(Seventh Embodiment)

Figure 28A:
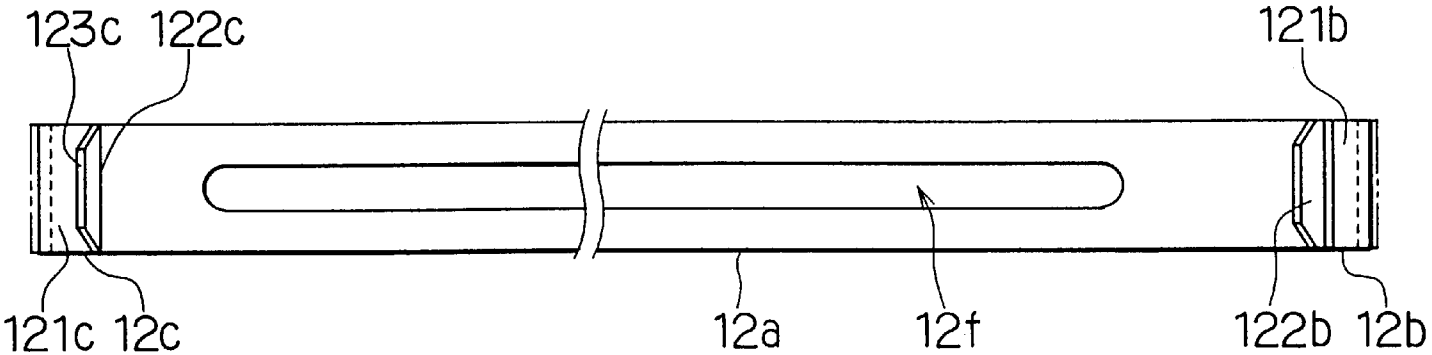
FIGS. 28A, 28B, and 28C illustrate a fastening member according to a sixth embodiment of the present invention.
Figure 28B:
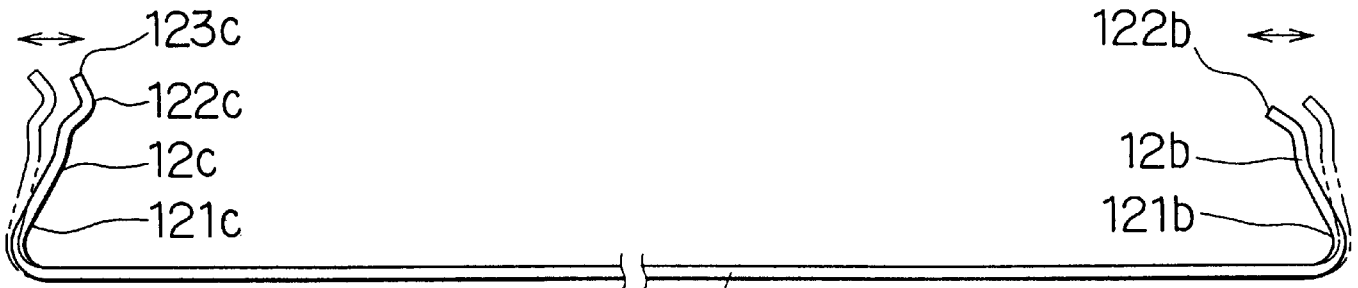
Figure 28C:
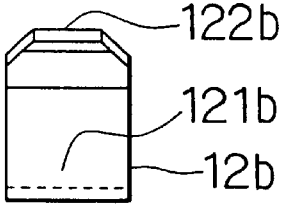

As shown in FIGS. 28A and 28B, the band portion 12*a* is as wide as the hook portions 12*b* and 12*c*. Instead, the band portion 12*a* has a longitudinal draft opening 12*f*. The draft opening 12*f* can be divided into two or more openings.

(Eighth Embodiment)

Figure 29B:
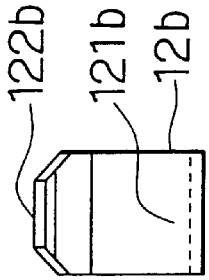
FIGS. 29A and 29B illustrate a fastening member according to a seventh embodiment of the present invention.
Figure 29A:
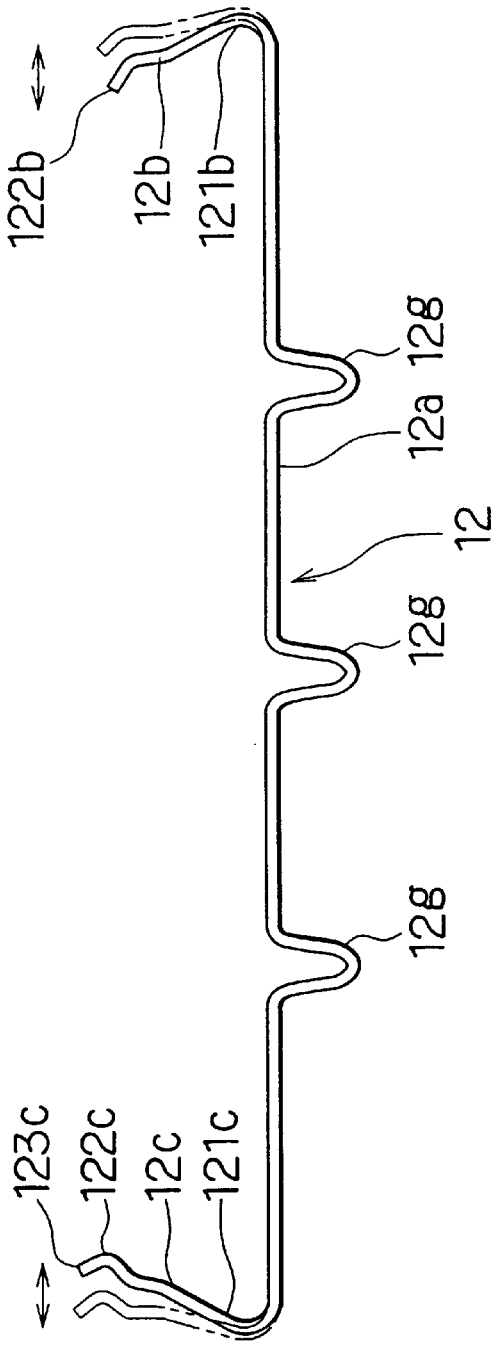

As shown in FIGS. 29A and 29B, the band portion 12*a* has a plurality of bends 12*g* projecting forward from the core unit 3. This makes the fastening members more flexible to improve the assembling productivity.

The present invention can be applied to various heat exchanger core having fins other than the corrugated fins, such as plate fins or the like.

The position of the PTC heater 9 can be changed in accordance with various specifications of the heat exchanger of the heaters.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A core unit of a heat exchanger including an inlet tank and an outlet tank for a heat carrier, said core comprising:

a plurality of corrugated fins disposed in parallel with each other;

a plurality of parallel flat tubes each of which is disposed in contact with first adjacent corrugated fins and connected to said inlet and outlet tanks to conduct said heat carrier; and a heater support member in contact with second adjacent corrugated fins in parallel with said plurality of flat tubes, said heater support member including a pair of plates parallelly extending along said flat tubes and an electric heater held between said pair of plates to generate heat when said heater is energized, thereby heating air flowing through said second adjacent corrugated fins, said electric heater being electrically insulated from said plurality of fins.

2. A core unit as claimed in claim 1, wherein said flat tubes, said corrugated fins and said support plates are made of aluminum and soldered with each other.

3. A core unit as claimed in claim 1, wherein said electric heater further comprises a plus electrode, a minus electrode and an insulating cover surrounding said two electrodes, and said electric heater is inserted between said pair of plates.

4. A core unit as claimed in claim 3, wherein each of said plus electrode and said minus electrode has a connecting terminal integrally formed thereon.

5. A core unit as claimed in claim 4, wherein each of said connecting terminals projects from corresponding one of said plus electrode and said minus electrode in a direction of thickness of said core unit.

6. A core unit as claimed in claim 4 further comprising means for holding said electric heater under pressure between said pair of plates.

7. A core unit as claimed in claim 1, wherein said electric heater has a positive temperature characteristic sharply changing resistance thereof at a set temperature, said electric heater is electrically insulated from said plurality of fins, and said electric heater heats portions of said fins adjacent to said flat tubes at a temperature equal to temperature of said heat carrier in said flat tubes if a temperature of said heat carrier is equal to or higher than 60° C. and temperature of air to be heated is equal to or lower than 0° C.

8. A core unit as claimed in claim 1, wherein said electric heater has a positive temperature characteristic sharply changing resistance thereof at a set temperature, said electric heater is electrically insulated from said plurality of fins, said fins have summits disposed between two of said flat tubes, said fins have a height between 3.9 mm and 5 mm, and said set temperature of said electric heater is between 85° C. and 120° C.

9. A core unit of a heat exchanger core having an air inlet side and an air outlet side, said core comprising:

a plurality of parallelly disposed flat tubes which conduct heat carrier;

a plurality of corrugated fins disposed in contact with said flat tubes;

a support member having a pair of plates parallelly extending along said flat tubes, an opening end portion and a U-shaped closing end portion, said support member disposed between summits of corrugation of adjacent two of said corrugated fins, said U-shaped closing end portion is disposed at said air inlet side, each of said plates being bonded to one of said corrugated fins at summits of corrugation; and an electric heater disposed between said support plates and insulated from said support member.

10. A core unit as claimed in claim 9, wherein said opening end portion projects from an end of said electric heater.

11. A core unit as claimed in claim 9, wherein said opening end portion spreads in a skirt-shape.

12. A core unit as claimed in claim 9, wherein said support member has the same thickness as said core unit in the air flow direction, and said electric heater has smaller thickness in the direction of core thickness than said support member, and said support member comprises means for positioning said electric heater therein.

13. A core unit as claimed in claim 12, wherein said means for positioning comprises a stopper projecting inside from at least one of said two plates.

14. A core unit for a heater as claimed in claim 13, wherein one of said plates has a reinforcement rib disposed between said stopper and said closing end portion.

15. A core unit as claimed in claim 13, wherein said means for positioning comprises a stopper member disposed between said electric heater and said closing end portion.

16. A core unit as claimed in any one of claim 9, wherein each of said flat tubes, corrugated fins and support member is made of aluminum and soldered to each other.

17. A core unit as claimed in claim 9, wherein said electric heater comprises a plus electrode, a minus electrode, a heating element disposed between said two electrodes, and an insulating cover member covering said two electrodes, and said cover member is pressed fitted between said plates to hold said electric heater therein.

18. A core unit as claimed in claim 17, wherein each of said plus electrode and said minus electrode has a connecting terminals projecting therefrom.

19. A core unit as claimed in claim 9 further comprising a fastening member, disposed on said air outlet side of said core unit, said for holding said electric heater in said support member.

20. A core unit of a heat exchanger including an inlet tank and an outlet tank for a heat carrier, said core unit comprising:

a plurality of parallelly disposed flat tubes which conduct said heat carrier;

a plurality of corrugated fins having summits disposed in contact with said plurality of flat tubes; and an electric heater disposed between two of said plurality of corrugations in parallel with said plurality of flat tubes, said electric heater having a positive temperature characteristic sharply changing resistance thereof at a set temperature, said electric heater being electrically insulated from said plurality of fins, wherein said electric heater with said set temperature heats portions of said fins adjacent to said flat tubes at a temperature equal to temperature of said heat carrier in said flat tubes if a temperature of said heat carrier is equal to or higher than 60° C. and temperature of air to be heated is equal to or lower than 0° C.

21. A core unit of a heat exchanger including an inlet tank and an outlet tank for a heat carrier, said core unit comprising:

a plurality of parallelly disposed flat tubes which connect said inlet and outlet tanks to said heat carrier;

a plurality of corrugated fins each of which is disposed between two of said flat tubes;

an electric heater disposed at a portion of said heat exchanger core in parallel with said flat tubes, said electric heater having a positive temperature characteristic sharply changing resistance thereof at a set temperature, said electric heater being electrically insulated from said plurality of fins, wherein said fins have summits disposed between two of said flat tubes, said fins have a height between 3.9 mm and 5 mm, and said set temperature of said electric heater is between 85° C. and 120° C.

22. A core unit as claimed in claim 20, wherein said core unit is made of aluminum alloy, said electric heater is a three-layered sandwich structure composed of an electric heater element and two flat electrodes on opposite sides of said electric heater element and is inserted between said corrugated fins and said two electrodes, and said two electrodes are pressed fitted to said summits of the corrugation.

23. A core unit as claimed in claim 22, wherein said heater element has a positive temperature characteristic sharply changing resistance thereof at a set temperature which is between 120° C. and 170° C.

24. A method of manufacturing a core unit of a heat exchanger to be assembled with an inlet tank and an outlet tank, said core unit being composed of a plurality of parallelly disposed flat tubes, corrugated fins having summits, a pair of support plates and an electric heater, said method comprising steps of:

stacking a portion of said flat tubes of said heat exchanger core and said corrugated fins alternately;

stacking said pair of support plates in the same manner as said flat tubes between said summits of corrugation at a portion where said electric heater is to be disposed;

soldering said flat tubes, said corrugated fins and said support plates into a unit; and inserting said electric heater between said two plates such that said electric heater is electrically insulated from said plurality of fins.

25. The core unit as claimed in claim 1, wherein said heater support member comprises a U-shaped support plate having a U-shaped closing portion located at the air inlet side of said core unit.

26. The core unit as claimed in claim 1, further comprising a fastening member for applying fastening force to said core unit so that said electric heater can be tightly held in said support member.

27. The core unit as claimed in claim 26, wherein said fastening member has a pair of hook portions at opposite ends thereof and a band portion between said hook portions, and said band portion is narrower than said hook portions to reduce draft resistance of air passing through said core unit.

28. The core unit as claimed in claim 27, wherein said band portion has a bend projecting forward from said core unit.

29. The core unit as claimed in claim 26, further comprising an upper side plate disposed on upper side of said core unit and a lower side plate disposed under a lower side of said core unit, wherein each of said upper and lower side plates has a plurality of reinforcement ribs and at least one groove between said ribs, and said hook portions are engaged with said groove of said upper and lower side plates.

30. The core unit as claimed in claim 29, wherein said hook portions respectively have members for applying fastening force to one of said ribs.

31. A core unit of a heat exchanger comprising:

a plurality of cooling fins disposed in parallel with each other;

a plurality of parallel tubes each of which is disposed in contact with first adjacent one of said cooling fins;

a heater support member in contact with second adjacent one of said cooling fins in parallel with said plurality of tubes, said heater support member extending along said tubes;

an electric heater held by said heater support member, said electric heater being electrically insulated from said plurality of fins; and a fastening member for applying fastening force to said core unit so that said electric heater can be tightly held in said support member, said fastening member having a pair of hook portions at opposite ends thereof and a band portion between said hook portions, said band portion having longitudinal draft opening to reduce draft resistance of air passing through said core unit.

32. The core unit as claimed in claim 31, wherein said band portion has a bend projecting forward from said core unit.

33. The core unit as claimed in claim 31, further comprising an upper side plate disposed on upper side of said core unit and a lower side plate disposed under a lower side of said core unit, wherein each of said upper and lower side plates has a plurality of reinforcement ribs and at least one groove between said ribs, and said hook portions are engaged with said groove of said upper and lower side plates.

34. The core unit as claimed in claim 33, wherein said hook portions respectively have members for applying fastening force to one of said ribs.

35. The core unit as claimed in claim 33, wherein each of said hook portions has an arc-shaped portion.

36. The core unit as claimed in claim 31, wherein one of said pair of hook portions has an inwardly extending nail portion, and the other of said pair of hook portions has an inward projection and a guide portion.

37. The core unit as claimed in claim 31, wherein each of said plurality of tubes is a flat tube, each of said plurality of cooling fins is a corrugated fin having a plurality of summits, said heater support member comprise a U-shaped member disposed between said summits.

* * * * *